US011643230B2

(12) United States Patent
Cousins et al.

(10) Patent No.: US 11,643,230 B2
(45) Date of Patent: May 9, 2023

(54) ROTARY ARM FOR STRETCH WRAPPING MACHINE

(71) Applicants: Neil G. Cousins, Tottenham (CA); Srbislav Z. Davidovic, Oakville (CA)

(72) Inventors: Neil G. Cousins, Tottenham (CA); Srbislav Z. Davidovic, Oakville (CA)

(73) Assignee: COUSINS PACKAGING INC., Mississauga (CA)

( * ) Notice: Subject to any disclaimer, the term of this patent is extended or adjusted under 35 U.S.C. 154(b) by 14 days.

(21) Appl. No.: 17/102,926

(22) Filed: Nov. 24, 2020

(65) Prior Publication Data

US 2022/0161949 A1 May 26, 2022

(51) Int. Cl.
*B65B 11/02* (2006.01)

(52) U.S. Cl.
CPC ..... *B65B 11/025* (2013.01); *B65B 2210/20* (2013.01)

(58) Field of Classification Search
USPC ..... 53/234
See application file for complete search history.

(56) References Cited

U.S. PATENT DOCUMENTS

| | | | | |
|---|---|---|---|---|
| 4,722,170 | A | 2/1988 | Ball et al. | |
| 5,315,809 | A | 5/1994 | Gordon et al. | |
| 2005/0198922 | A1* | 9/2005 | Huson | B65B 11/025 53/399 |
| 2016/0200467 | A1* | 7/2016 | Cousins | B65B 11/025 53/556 |
| 2018/0162660 | A1 | 6/2018 | Saylor | |
| 2019/0166769 | A1* | 6/2019 | Little | A01F 15/0715 |

FOREIGN PATENT DOCUMENTS

| | | | | |
|---|---|---|---|---|
| CA | 2959894 | A1 * | 10/2017 | A01F 15/071 |
| EP | 1454827 | A2 | 9/2004 | |
| WO | 01/98152 | A2 | 12/2001 | |
| WO | 02/083501 | A1 | 10/2002 | |

OTHER PUBLICATIONS

Partial Search Report issued in corresponding European Application No. 21202430.1, dated Apr. 7, 2022 (11 pages).
Brochure from 2017 showing a bumper that moves along an arc that is perpendicular to a face of the bumper by parallel arcuate sliding members connected to a top and a bottom of the bumper (2 pages).
Search Report issued in corresponding European Application No. 21202430.1, dated Jul. 4, 2022 (12 pages).

* cited by examiner

*Primary Examiner* — Chinyere J Rushing-Tucker
(74) *Attorney, Agent, or Firm* — Flynn Thiel, P.C.

(57) ABSTRACT

A wrapping machine comprising a base and a wrapping arm connected to the base and configured to be movable relative to the base. The wrapping arm includes a carriage vertically movable on the wrapping arm, with the carriage having a roll of wrap film. The wrapping machine also includes a bumper assembly movable with the wrapping arm. The bumper assembly includes a bumper and an actuator, wherein engagement of the bumper with an external object will actuate the actuator to stop movement of the wrapping arm about the product. The wrapping arm can include side tubes connected by a connection tube, with the side tubes forming a link recess between the side tubes. Each of the side tubes includes an exteriorly facing slot, with the carriage riding on the side tubes along the slot. A link moves within the link recess to move the carriage.

21 Claims, 21 Drawing Sheets

ROTARY ARM FOR STRETCH WRAPPING MACHINE

FIELD OF THE INVENTION

The present invention concerns wrapping machines, and more particularly relates to a rotary arm for a wrapping machine.

BACKGROUND OF THE INVENTION

During the past several decades, considerable developments have been made in the field of wrapping a load with a web of film.

SUMMARY OF THE INVENTION

An aspect of the present invention is to provide a wrapping machine comprising a base and a wrapping arm connected to the base and configured to be movable relative to the base. The wrapping arm includes a carriage vertically movable on the wrapping arm, with the carriage having a roll of wrap film. The wrapping machine further includes at least one motor for moving the wrapping arm in a substantially circular direction and for moving the carriage vertically on the wrapping arm; the wrapping arm being connected to the base such that the wrapping arm can move in the substantially circular direction about a product to wrap the product with film. The wrapping machine also includes a bumper assembly movable with the wrapping arm. The bumper assembly includes a bumper and an actuator, wherein engagement of the bumper with an external object will actuate the actuator to stop movement of the wrapping arm about the product.

Another aspect of the present invention is to provide a method of safely wrapping goods comprising providing a wrapping machine including a base and a wrapping arm, with the wrapping arm including a carriage having a roll of wrap film; moving the wrapping arm about a product in a substantially circular direction and moving the carriage vertically to wrap the product with film from the roll of wrap film; moving a bumper assembly with the wrapping arm, the bumper assembly being pivotally connected to a top of the wrapping arm at a pivot connection and including a bumper; and stopping movement of the wrapping arm when the bumper abuts an external object, causing the bumper assembly to pivot about the pivot connection.

Yet another aspect of the present invention is to provide a wrapping machine comprising a base and a wrapping column connected to the base. The wrapping arm includes a carriage vertically movable on the wrapping arm, with the carriage having a roll of wrap film. A motor moves the carriage vertically on the wrapping arm to wrap the product. A link connects the motor and the carriage for moving the carriage on the wrapping arm. The column includes a pair of side tubes connected by a connection tube located between the side tubes, with the pair of side tubes forming a link recess between the side tubes and adjacent the connection tube. The link recess is open opposite the connection tube. Each of the side tubes includes an exteriorly facing slot. The carriage rides on the side tubes along the slot of each of the side tubes. The link moves within the link recess to move the carriage along the column.

DETAILED DESCRIPTION OF THE PREFERRED EMBODIMENT

Figure 1:
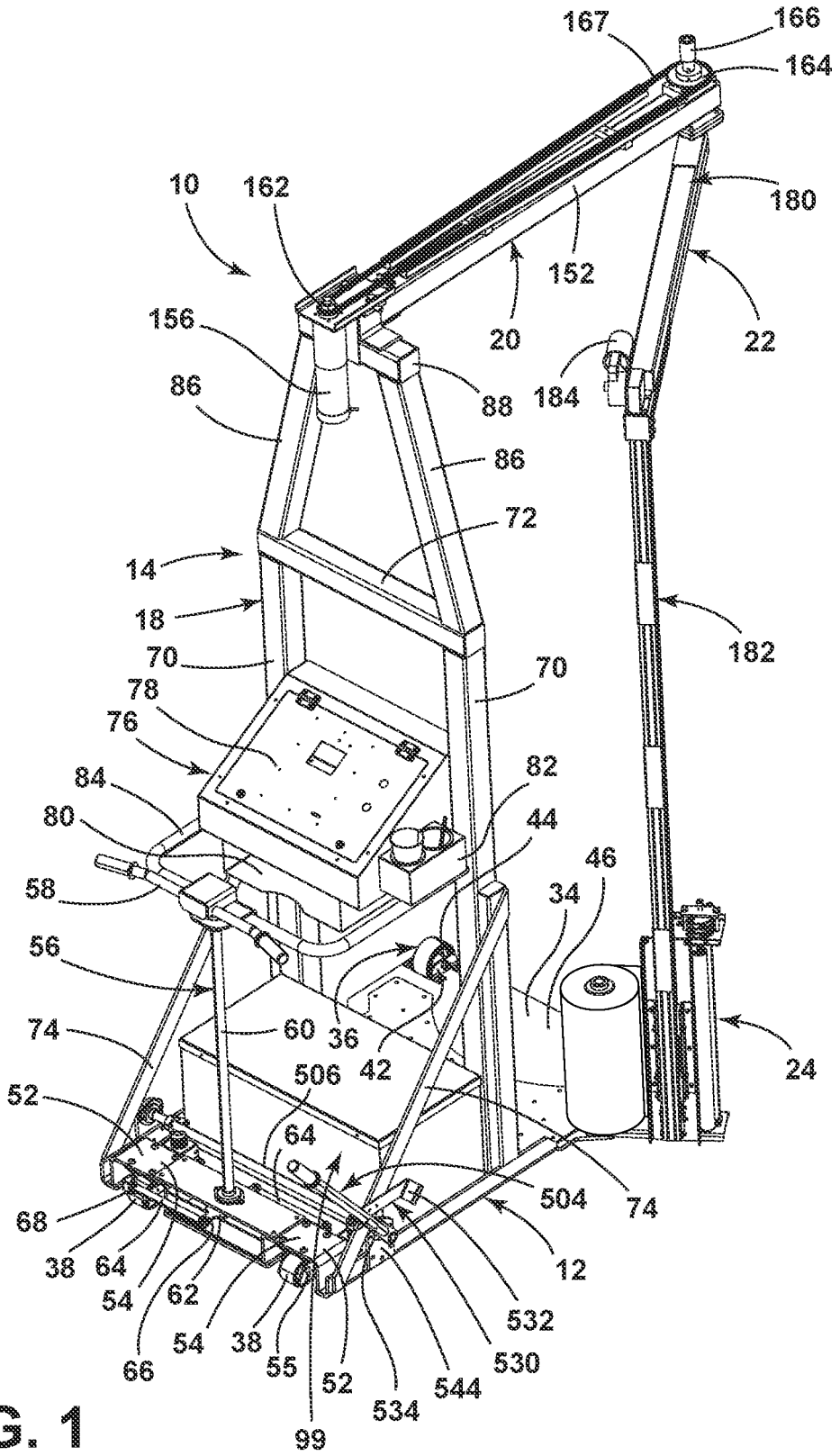
FIG. 1 is a first rear perspective view of a portable wrapping machine of the present invention.
Figure 2:
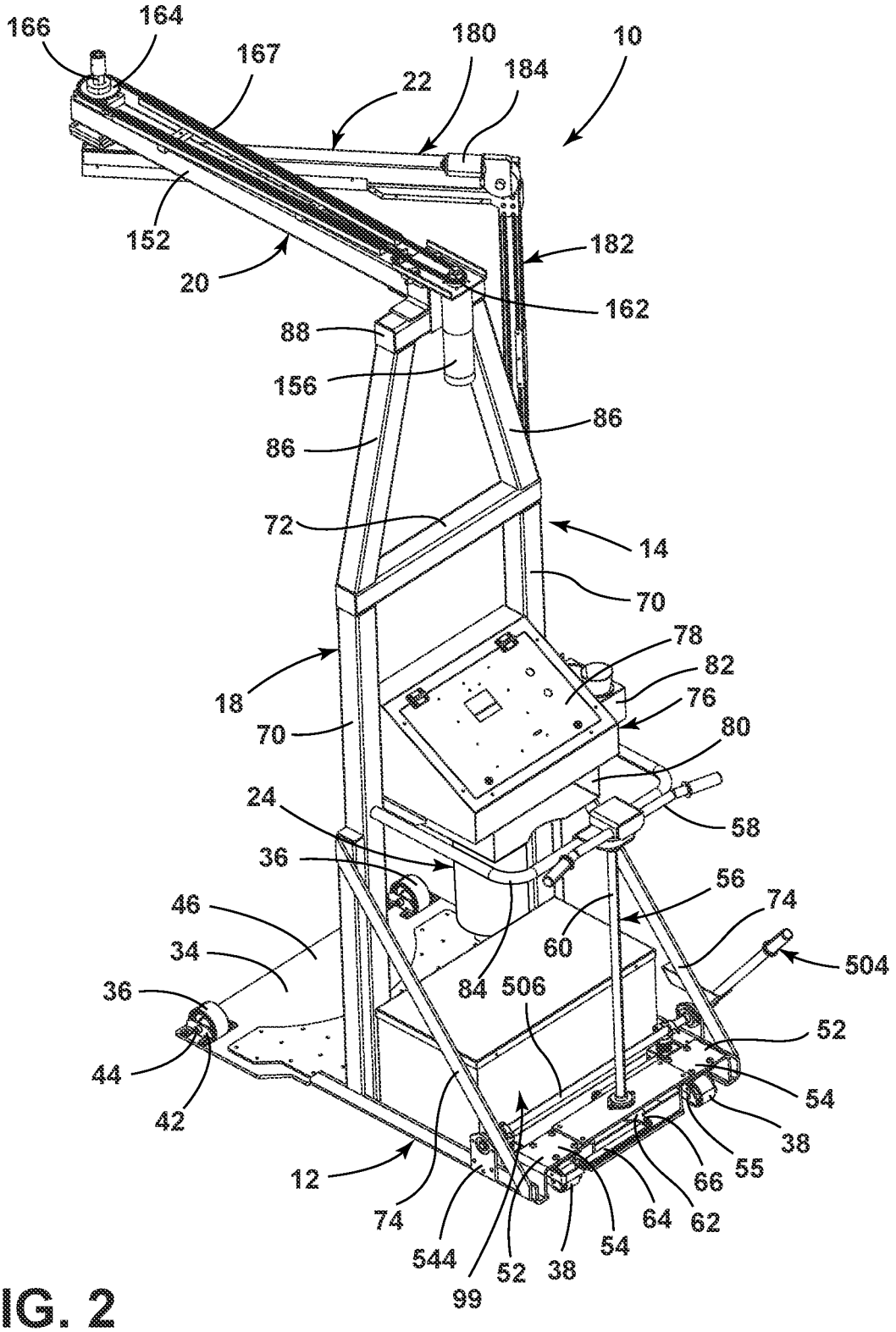
FIG. 2 is a second rear perspective view of the portable wrapping machine of the present invention.
Figure 3:
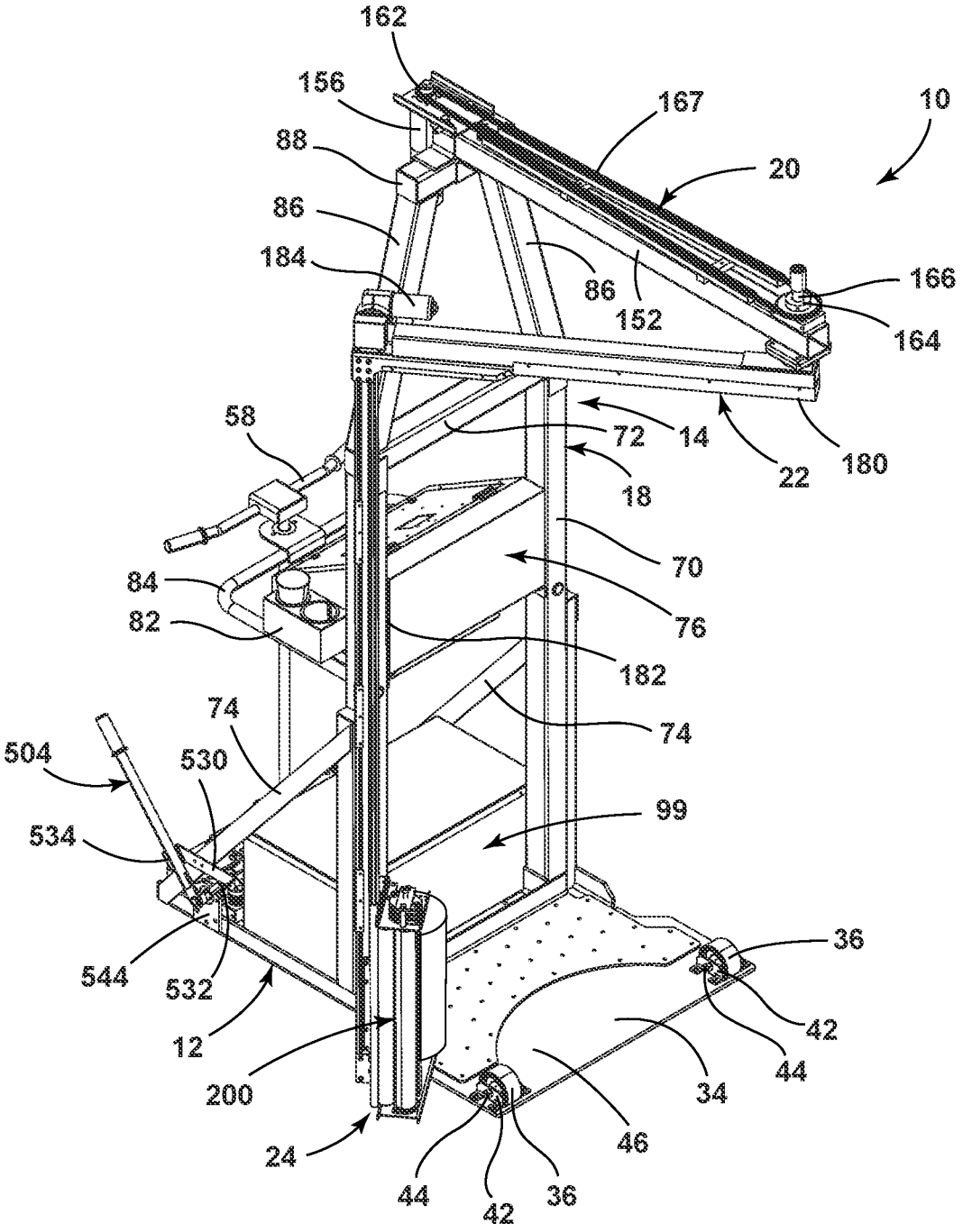
FIG. 3 is a first front perspective view of the portable wrapping machine of the present invention.
Figure 4:
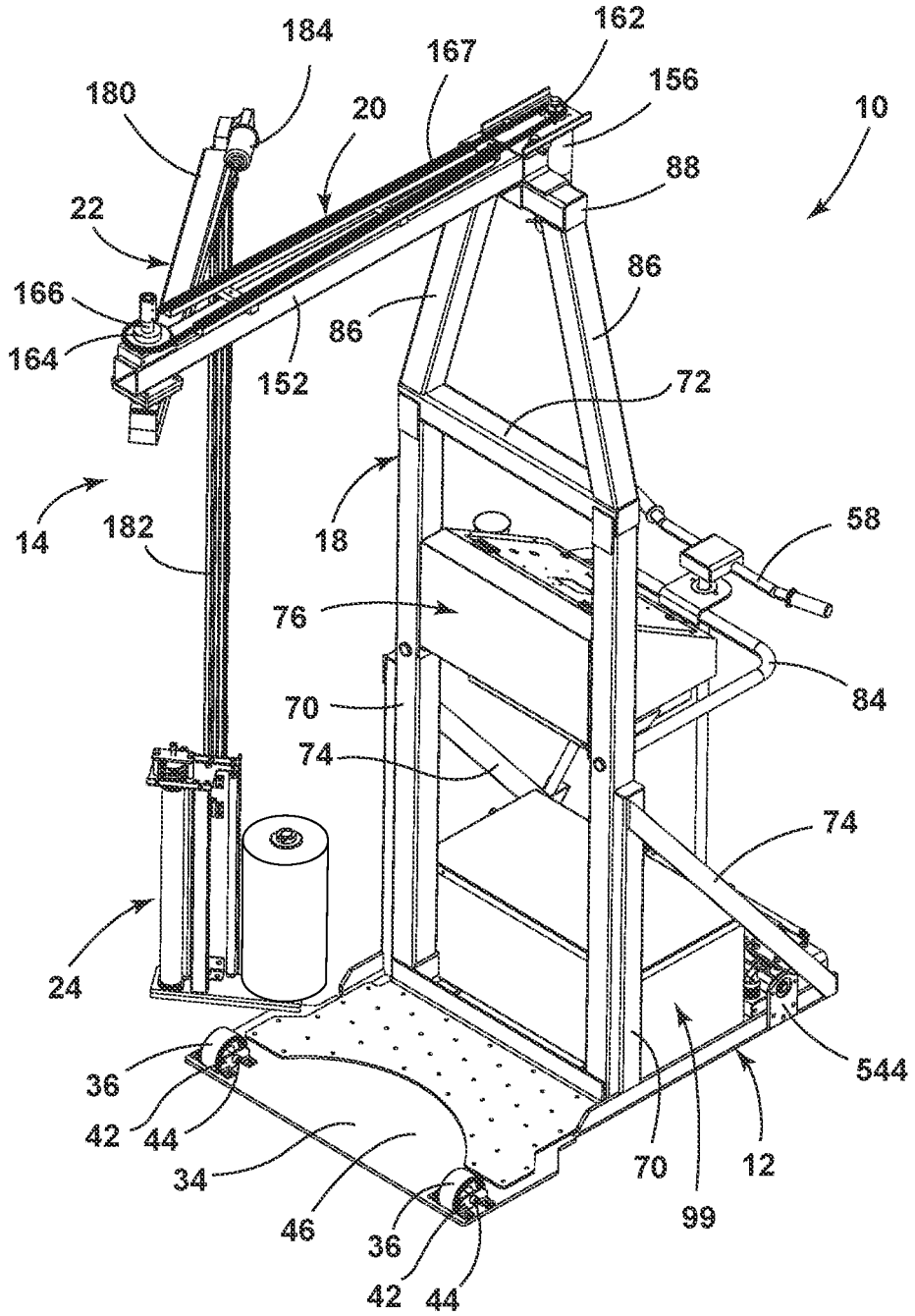
FIG. 4 is a second front perspective view of the portable wrapping machine of the present invention.
Figure 5:
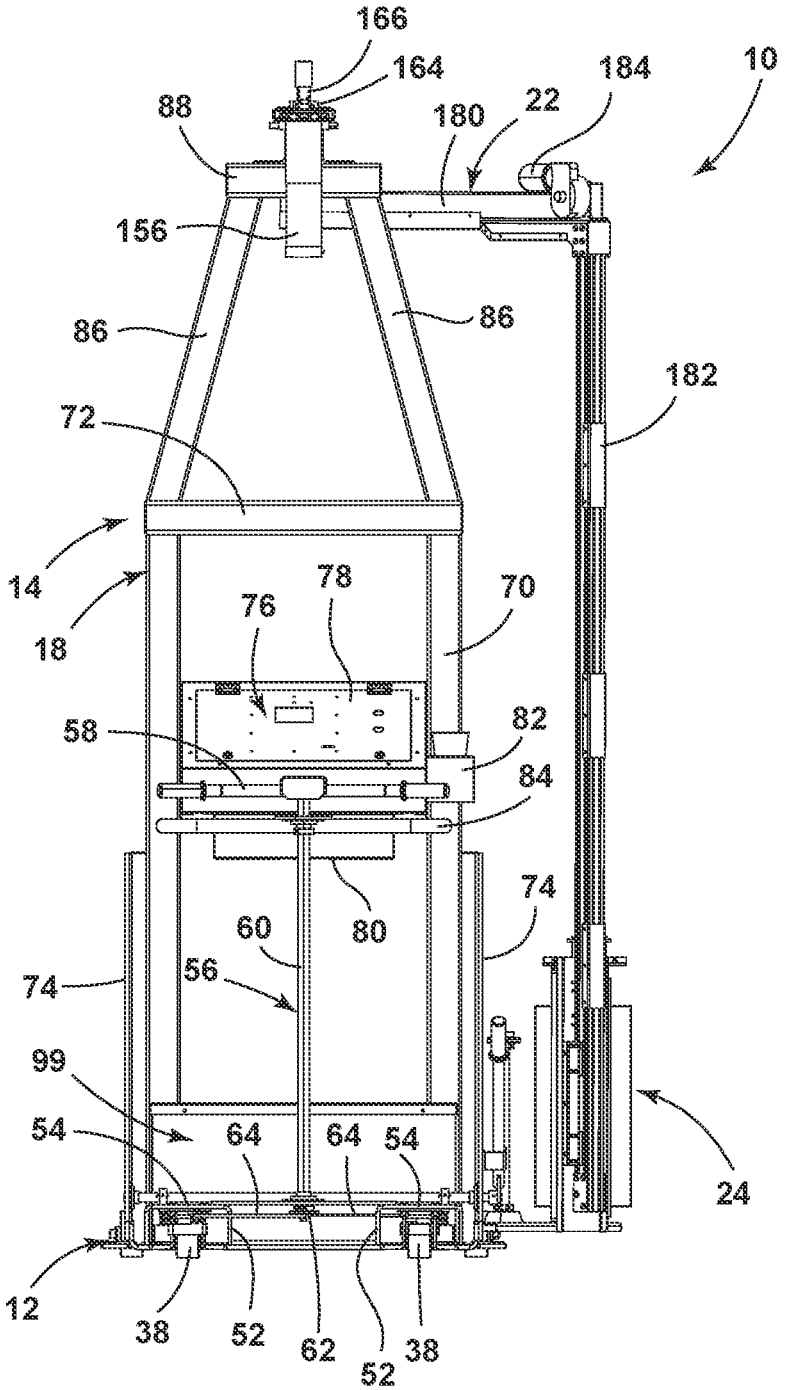
FIG. 5 is a rear view of the portable wrapping machine of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts. Hence, specific dimensions and other physical characteristics relating to the embodiments disclosed herein are not to be considered as limiting.

The reference number 10 (FIGS. 1-8) generally designates a portable wrapping machine of the present invention. The portable wrapping machine 10 is configured to be moved adjacent to a pallet 32 having goods 28 on a top surface thereof to wrap the goods 28 with wrap film 11. The goods 28 can be a single product (open or boxed) or a plurality of products (open or boxed). The portable wrapping machine 10 is portable to allow the portable wrapping machine 10 to be moved to the pallet 32 with the goods thereon instead of moving the pallet 32 to a stationary wrapping machine. The portable wrapping machine 10 is configured to be movable such that the portable wrapping machine 10 can be moved to the goods 28 and wrap the goods 28 from a top 16 thereof to the floor 30 to thereby allow the pallet 32 under the goods 28 to be wrapped.

In the illustrated example, the portable wrapping machine 10 includes a movable base 12 having a wrapping column 14 mounted thereon. The wrapping column 14 includes a post assembly 18, a cantilevered arm 20 extending from a top of the post assembly 18 and an inverted L-shaped wrapping arm 22 depending downwardly from the cantilevered arm 20. A carriage 24 rides on the inverted L-shaped wrapping arm 22. The wrap film 11 is pulled from a roll 26 of wrap film 11 on the carriage 24 to wrap the goods 28 (see FIGS. 7-8) while the inverted L-shaped wrapping arm 22 rotates about the goods 28.

In the illustrated example, the movable base 12 allows the portable wrapping machine 10 to be moved to the goods 28 to wrap the goods 28 with the wrap film 11. The movable base 12 includes a support plate 34 having at least one front wheel 36 and at least one rear wheel 38 connected thereto, with the at least one front wheel 36 and the at least one rear wheel 38 allowing the movable base 12 and thereby the portable wrapping machine 10 to be moved. In the illustrated example, the movable base 12 has a pair of front wheels 36 and a pair of rear wheels 38. However, it is contemplated that only one rear wheel 38 or only one front wheel 36 could be used or multiple wheels could be used. The support plate 34 is formed of any material that can provide stability to and support every element on the support plate 34. For example, the support plate 34 can be formed of metal (e.g., solid steel of ⅜-inch or ½-inch thickness) or any other stable material.

The illustrated front wheels 36 extend through openings 40 at the front of the support plate 34. A pair of L-shaped axle supports 42 connected to a top of the support plate 34 straddle each front wheel 36 and a front wheel axle 44 extends though the adjacent front wheel 36 and into the pair of L-shaped axle supports 42 to allow the front wheel 36 to rotate. The front wheel axle 44 is located above a top surface 46 of the support plate 34 to allow the support plate 34 to have a low profile and be located close to the floor 30. As shown, the front wheel axles 44 are fixed in position relative to the support plate 34 such that the front wheels 36 are not allowed to turn to be able to turn the portable wrapping machine 10. However, it is contemplated that the front wheels 36 could be configured to turn. Furthermore, the front wheels 36 are configured as passive wheels such that the front wheels 36 do not have their own propulsion system. However, it is contemplated that the front wheels 36 could be powered casters to help move the portable wrapping machine 10.

Figure 6:
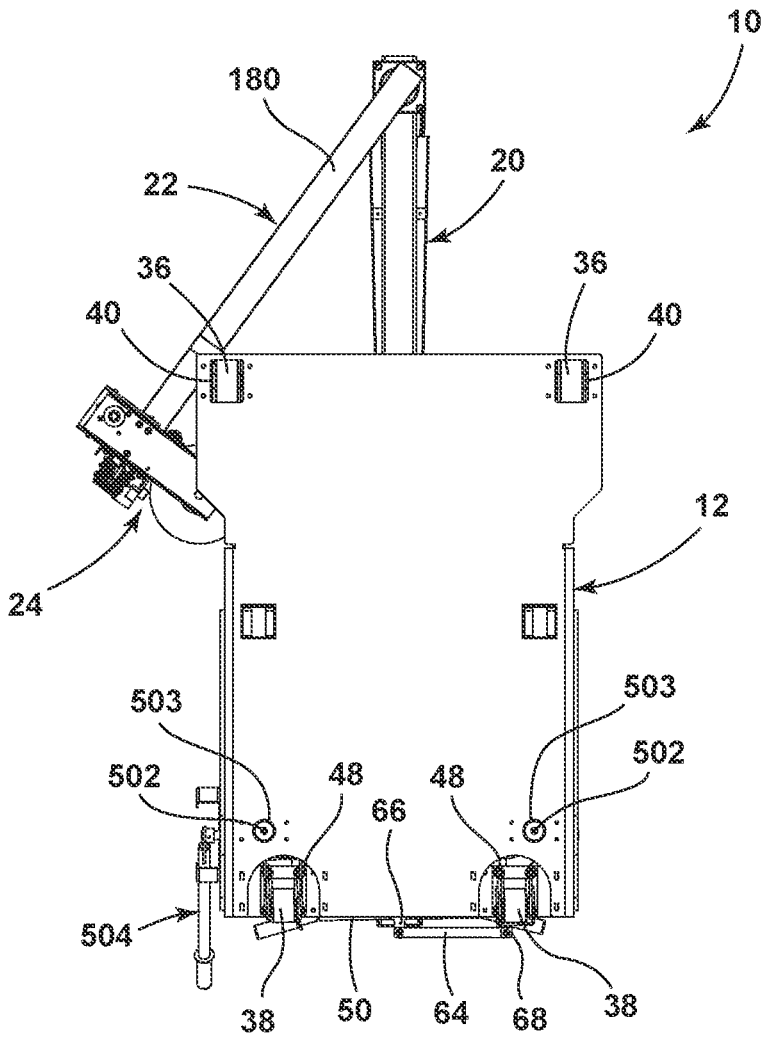
FIG. 6 is a bottom view of the portable wrapping machine of the present invention.

In the illustrated example, the rear wheels 38 are rotatable to allow the movable base 12 to be turned. As shown in FIG. 6, the support plate 34 can have recesses 48 at a rear edge 50 thereof to allow the rear wheels 38 to rotate. While the rear wheels 38 are shown as being located within recesses 48 that extend to the rear edge 50, it is contemplated that the recesses 48 could be located entirely within the periphery of the support plate 34. An inverted U-shaped support 52 is located above each recess 48 and the rear wheels 38 are casters connected to a top portion 54 of the inverted U-shaped support 52. The illustrated rear wheels 38 are free to rotate about a vertical axis connected to the inverted U-shaped support 52 and a horizontal axis of an axle 55 of the caster. While a pair of rear wheels 38 are shown, it is contemplated that a single rear wheel 38 could be used. However, the single rear wheel 38 should be used with a pair of front wheels 36. Furthermore, the rear wheels 38 are configured as passive wheels such that the rear wheels 38 do not have their own propulsion system. However, it is contemplated that the front wheels 36 could be powered casters to help move the portable wrapping machine 10.

The illustrated portable wrapping machine 10 includes a steering assembly 56 that is used to push and pull the portable wrapping machine 10 as well as turn the rear wheels 38. The steering assembly 56 includes a steering handle 58, a connecting post 60, a bottom transfer plate 62 and a pair of levers 64. The steering assembly 56 is employed to turn the rear wheels 38 by turning the steering handle 58, with the rotational motion of the steering handle 58 in turn rotating the connecting post 60 and the bottom transfer plate 62. The illustrated steering handle 58, the connecting post 60 and the bottom transfer plate 62 form a solid connection and turn as an integral part. The bottom transfer plate 62 includes a pair of oppositely extending arms 66, with each of the arms 66 being connected to one of the levers 64. As the steering handle 58 and thereby the bottom transfer plate 62 rotate, the levers 64 move along a line to push and pull a wheel arm 68 connected to each of the rear wheels 38. As the bottom transfer plate 62 rotates, the levers 64 push the rear wheels 38 in the same direction, thereby turning the rear wheels 38 and allowing the portable wrapping machine 10 to turn. While a particular system for steering the portable wrapping machine 10 is shown in the drawings, it is contemplated that any system could be employed to turn the rear wheels 38 (and/or the front wheels 36) of the portable wrapping machine 10, including a steer by wire system.

In the illustrated example, the movable base 12 is used to bring the wrapping column 14 to the goods 28 for wrapping the goods 28 (and the pallet 32 if desired). The post assembly 18 of the wrapping column 14 is connected to a top of the support plate 34 adjacent a middle portion thereof and in front of the steering assembly 56. The post assembly 18 includes a pair of spaced parallel vertically extending posts 70. The posts 70 can have braces (not shown) extending between inside surfaces thereof to provide for extra stability for the post assembly 18. A pair of angled side struts 74 can extend from outside surfaces of the posts 70 to a rear portion of the movable base 12 for extra stability. A middle cross-member 72 extends between tops of the posts 70. In the illustrated example, a control panel box 76 can also extend between the posts 70 for further support. The control panel box 76 includes a control panel 78 having buttons and/or switches for controlling the wrapping of the portable wrapping machine 10 and can include a shelf 80 extending from a bottom thereof and a cup holder 82 connected to a side thereof. A U-shaped arm 84 extends rearwardly from the posts 70 and supports a top portion of the connecting post 60 of the steering assembly 56. A top of the post assembly 18 includes a pair of converging pillars 86 connected to a top of the middle cross-member 72 and a top cross-member 88 connected to tops of the converting pillars 86. The cantilevered arm 20 extends from a top of the top cross-member 88.

The illustrated cantilevered arm 20 extends sidewardly from the top of the top cross-member 88 of the post assembly 18. The cantilevered arm 20 of the illustrated embodiment is beam 152 having a rectangular cross-sectional shape. An angled brace 154 (see FIG. 7) can extend between a bottom surface of the beam 152 and a side surface of the top cross-member 88 of the post assembly 18 for added stability. A first motor assembly 156 is connected to the beam 152 of the cantilevered arm 20 at a proximal end thereof and can be powered by a battery and/or a power source from the movable base 12. The first motor assembly 156 rotates the inverted L-shaped wrapping arm 22. The first motor assembly 156 rotates a first pulley wheel 162 connected to the first motor assembly 156. A second pulley wheel 164 is located on top of the beam 152 of the cantilevered arm 20 at a distal end thereof. An endless link 167 surrounds the first pulley wheel 162 and the second pulley wheel 164 such that rotation of the first pulley wheel 162 by the first motor assembly 156 causes the second pulley wheel 164 to rotate. A wrapping axle 166 is connected to the second pulley wheel 164 and rotates with the second pulley wheel 164. The inverted L-shaped wrapping arm 22 is also connected to the wrapping axle 166 and rotates with the wrapping axle 166.

In the illustrated example, the inverted L-shaped wrapping arm 22 rotates about the goods 28 to wrap the goods 28 with the wrap film 11. The inverted L-shaped wrapping arm 22 includes a horizontal portion 180 and a vertical portion 182. The carriage 24 is connected to the vertical portion 182 and is configured to move vertically along the vertical portion 182 of the inverted L-shaped wrapping arm 22. An inner end of the horizontal portion 180 of the inverted L-shaped wrapping arm 22 is connected to a bottom of the wrapping axle 166 and rotates with the wrapping axle 166. A second motor assembly 184 is located at a distal end of the horizontal portion 180 of the inverted L-shaped wrapping arm 22. The second motor assembly 184 includes a motor powered that can be powered by a battery and/or a power source from the movable base 12. The second motor assembly 184 includes a spool that is rotated by the motor thereof. A cable 190 extending along the vertical portion 182 is configured to be selectively pulled and wrapped onto the spool or unwound from the spool to raise and lower the carriage 24. Although a particular location of the first motor assembly 156 and the second motor assembly 184 as shown in the drawings for rotating the inverted L-shaped wrapping arm 22 and raising and lowering the carriage 24, it is contemplated that any system of motors, wheels and/or pulleys could be employed to rotate the inverted L-shaped wrapping arm 22 along with raising and lowering the carriage 24.

The illustrated carriage 24 includes the roll 26 of the wrap film 11 used to wrap the goods 28. In the illustrated example, the wrap is pre-stretched before being wrapped about the goods 28 using pre-stretch rollers 200 on the carriage. However, it is contemplated that the carriage 24 could pre-stretch the wrap in order to lengthen the wrap in a manner known to those skilled in the art. In the illustrated embodiment, several portions of the portable wrapping machine 10 are shown as not including a cover. For example, the horizontal portion 152, the pulley wheels 162 and 164, the endless link 167, and a portion of a movable stabilizer 500*a* detailed below are shown as being exposed. However, all of those portions of the portable wrapping machine 10 can be covered by covers.

Figure 7:
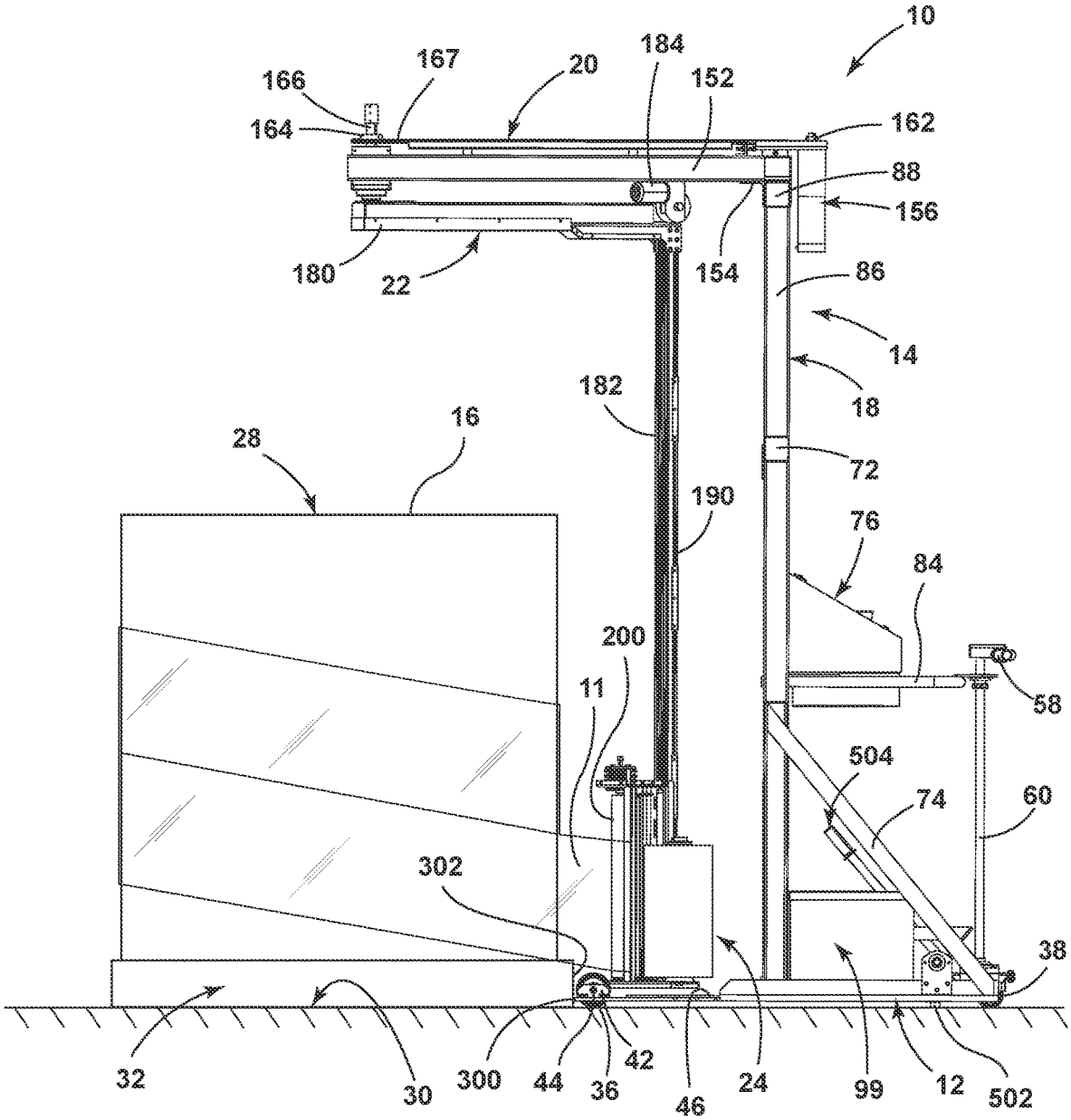
FIG. 7 is a side view of the portable wrapping machine of the present invention illustrating wrapping of goods on a pallet.
Figure 8:
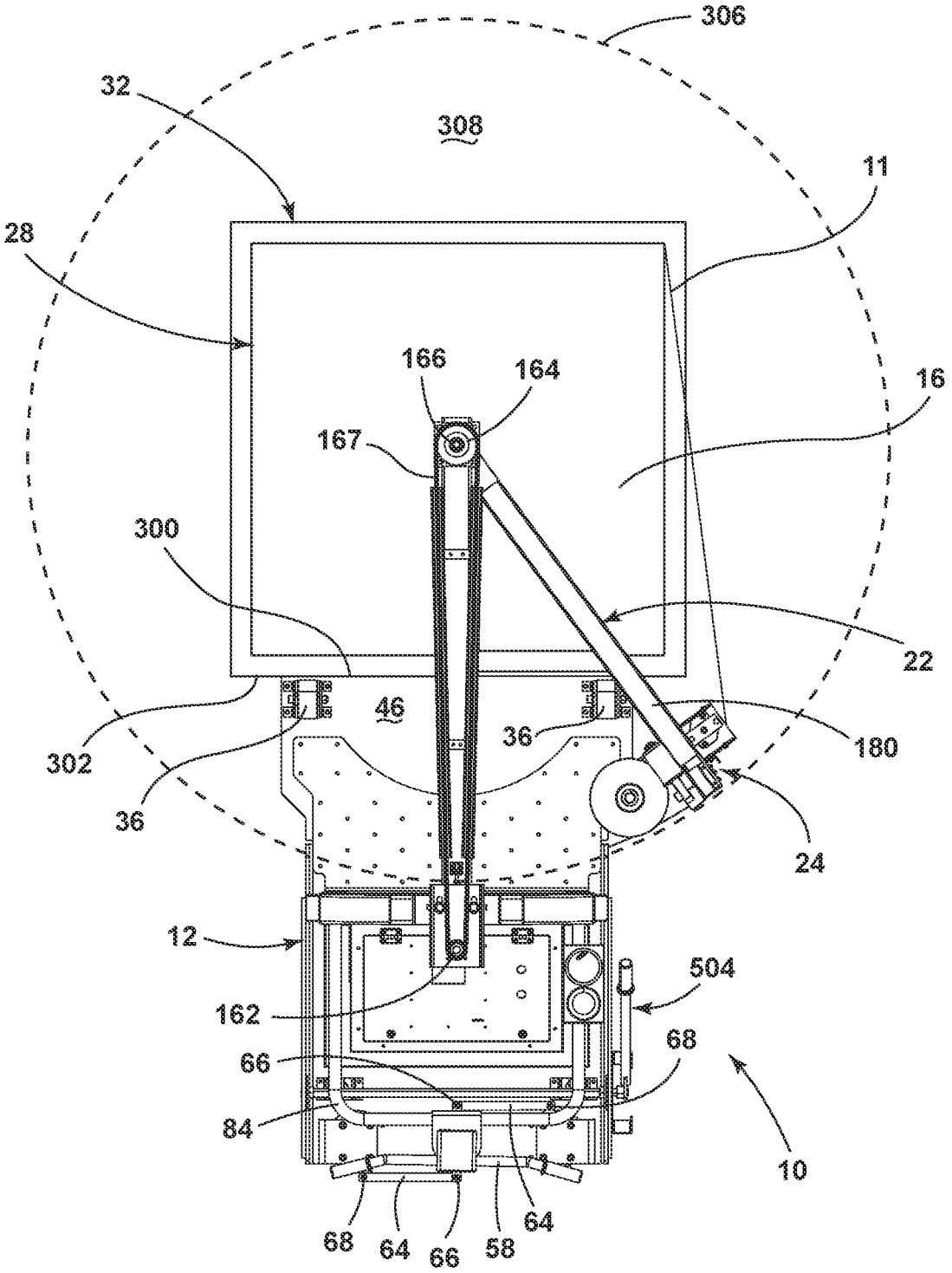
FIG. 8 is a top view of the portable wrapping machine of the present invention illustrating wrapping of goods on the pallet.

FIGS. 7 and 8 illustrate an embodiment of wrapping the goods 28 with the wrap film 11 using the portable wrapping machine 10. First, the portable wrapping machine 10 is moved to the pallet 32 until a front portion 300 of the base 12 (or an extension from the movable base 12) abuts a side surface 302 of the pallet 32. As shown, no portion of the portable wrapping machine 10 is located under the pallet 32 during this procedure such that the pallet 32 does not need any openings in the side surface 302 thereof for accepting a portion of the portable wrapping machine 10. At that point, the portable wrapping machine 10 is stabilized. For example, any or all of the wheels of the portable wrapping machine 10 can be locked in position and/or a movable stabilizer (with examples thereof discussed in more detail below) can be deployed.

Second, a free end of the wrap film 11 extending from the carriage 24 is positioned on the goods 28 or otherwise held on the goods 28. Third, the inverted L-shaped wrapping arm 22 is activated to rotate about the goods 28 with the carriage 24 moving up and down along the vertical portion 182 of the inverted L-shaped wrapping arm 22 by being pulled upward by the cable 190 (via the second motor assembly 184) and by being allowed to lower through the force of gravity to a selected position by the cable 190 (via the second motor assembly 184). The carriage 24 is allowed to move to a position slightly above the floor 30 to be able to position the wrap film 11 about the bottom of the goods 28 and the side surface 302 of the pallet 32, if desired. The carriage 24 and the inverted L-shaped wrapping arm 22 never need to touch the floor 30 to be able to wrap the bottom of the goods 28 and a top area of the sides of the pallet 32.

As shown in FIG. 8, a circle of rotation 306 of the inverted L-shaped wrapping arm 22 forms a periphery of a wrap circle area 308. At least one front wheel 36 of the movable base 12 of the portable wrapping machine 10 can be located within the wrap circle area 308 when the pallet 32 is viewed from above such as that shown in FIG. 8. During the step of encircling the goods 28 on the pallet 32 with the inverted L-shaped wrapping arm 22 to wrap the wrap film 11 around the goods 28, the wrap film 11 can abut and slide over the front wheels 36 (or a cover for the front wheels 36 that extends upward from the top surface 46 of the movable base 12) as the wrap film 11 passes over the front wheels 36. It is contemplated that the base 12 can include a storage compartment 99 for storing a battery or batteries (rechargeable or not) for powering the wheels 36 and 38, the first motor assembly 156, and/or the second motor assembly 184. It is further contemplated that the first motor assembly 156 and/or the second motor assembly 184 could be powered by a power cord connected to the portable wrapping machine 10 and plugged into a typical power outlet. Other power systems are also contemplated (e.g., induction power). Finally, it is contemplated that the portable wrapping machine 10 could selectively be powered by a battery or directly from an outlet.

Figure 9:
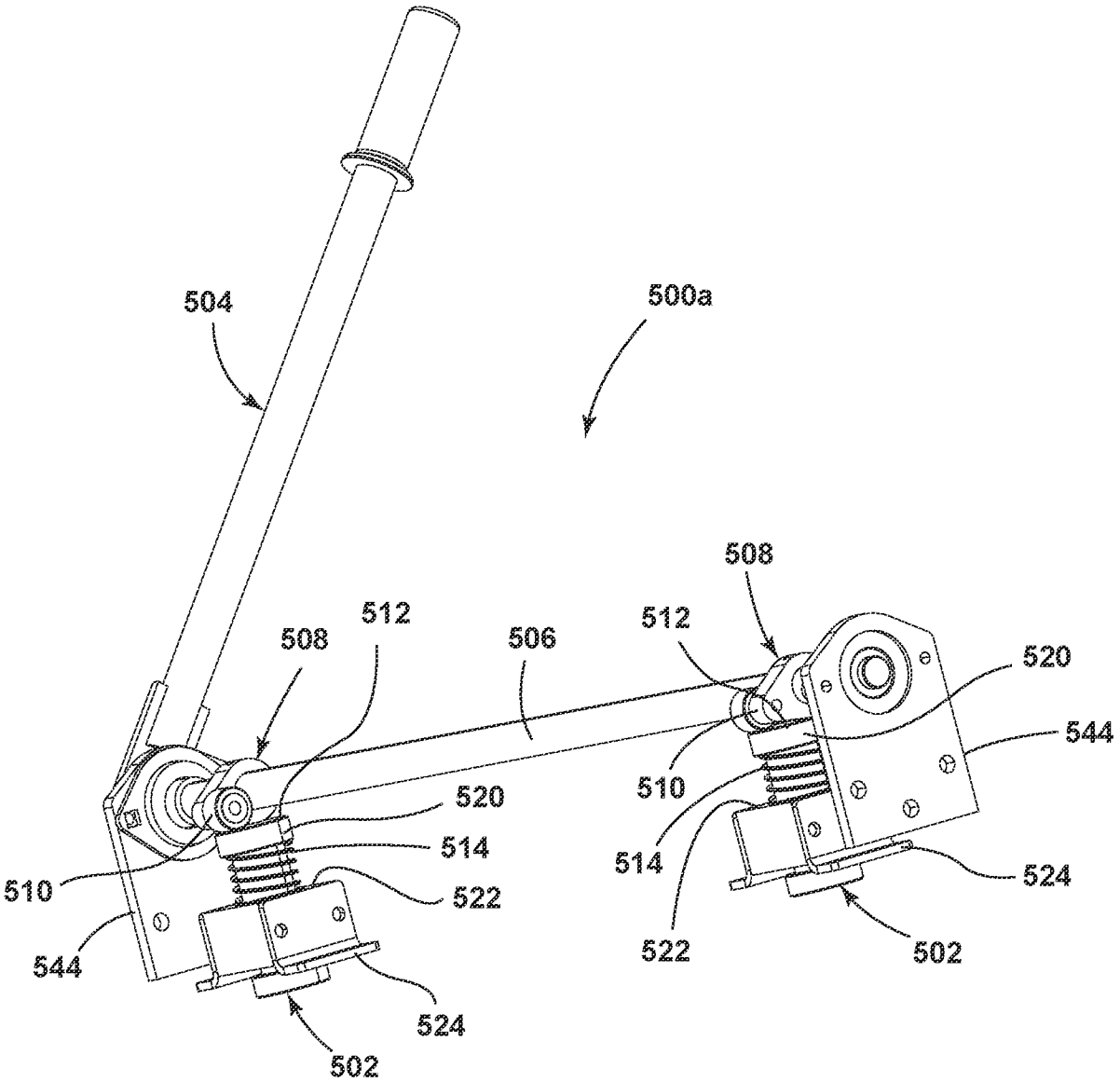
FIG. 9 is a perspective view of a first embodiment of a movable stabilizer of the portable wrapping machine of the present invention.

FIG. 9 illustrates an example of a movable stabilizer 500*a* for maintaining the portable wrapping machine 10 in a set location. The movable stabilizer 500*a* includes a pair of linearly movable feet 502 configured to selectively be lowered to abut the floor 30 to assist in maintaining the portable wrapping machine 10 adjacent the pallet 32. The movable stabilizer 500*a* includes a lever 504 that rotates a rod 506 having a pair of eccentric actuators 508 that abut against a top 512 of the feet 502. As the lever 504 is moved to rotate the rod 506, the eccentric actuators 508 have ears 510 that push and roll on the top 512 of the feet 502 to move the feet downward against the bias of springs 514 that are compressed between a rim 520 of the top 512 of the feet 502 and a top surface 522 of a holder 524 for the feet 502.

As illustrated in FIG. 1, the portable wrapping machine 10 includes a C-shaped movement limiting bar 530 that limits movement of the lever 504. As shown in FIGS. 7 and 8, when the lever 504 abuts against a deployment side 532 of the C-shaped movement limiting bar 530, the feet 502 stay deployed to stabilize the portable wrapping machine 10 because the ears 510 press the top 512 of the feet 502 downward. As shown in FIG. 6, the feet 502 extend through apertures 503 in the movable base 12 when in the deployed position. When the lever 504 is rotated in the opposite direction to abut against the stored side 534 of the C-shaped movement limiting bar 530, the ears 510 no longer press against the top 512 of the feet 502 to allow the feet 502 to move to the stored position. The movable stabilizer 500*a* includes a pair of support flanges 544 connected to the base 12 of the portable wrapping machine 10 holding opposite ends of the rod 506 to allow the rod 506 to rotate above an axis fixed in position relative to the movable base 12 of the portable wrapping machine 10. The holders 524 for the feet 502 are also connected to the movable base 12 of the portable wrapping machine 10.

Figure 10:
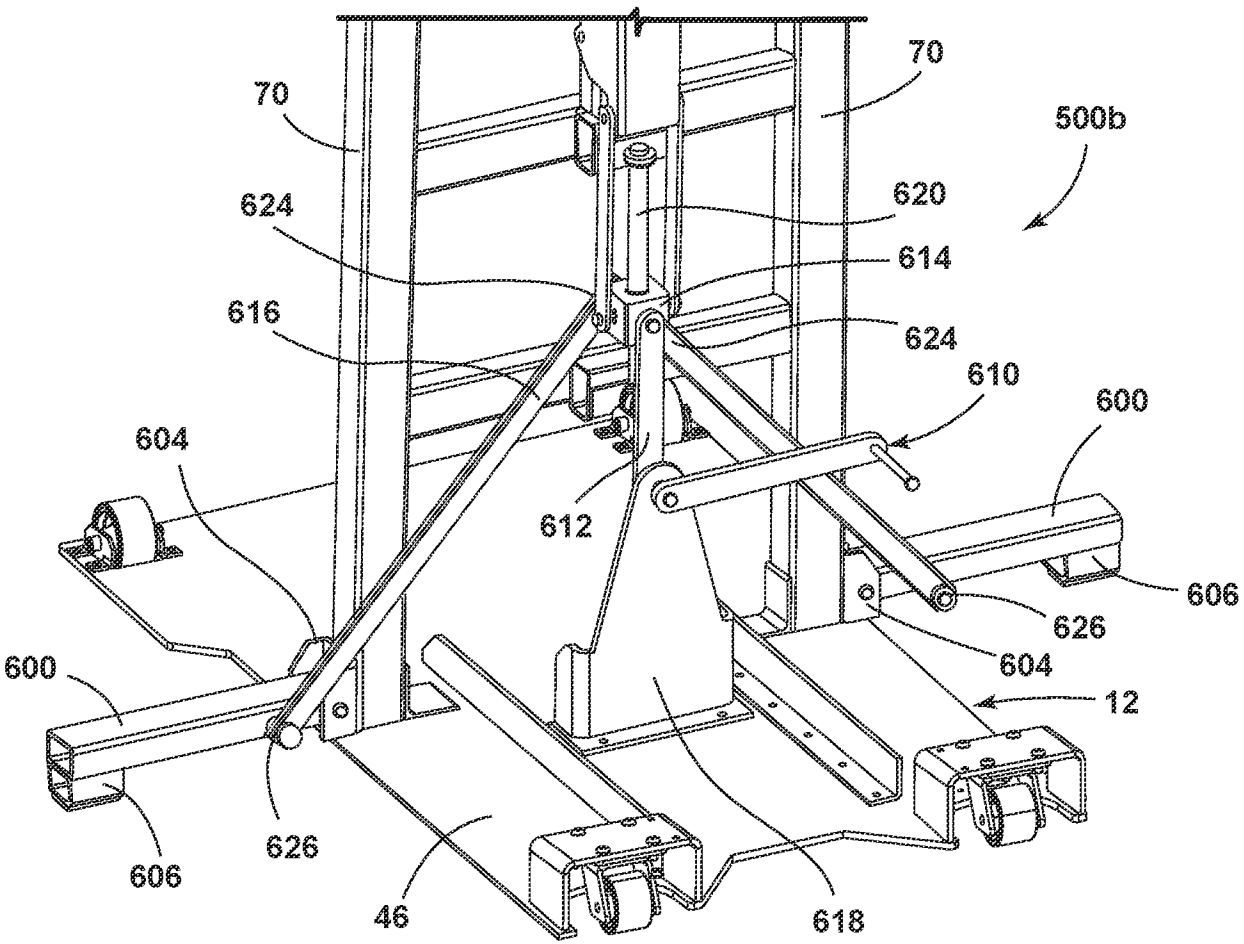
FIG. 10 is a perspective view of a second embodiment of a movable stabilizer of the portable wrapping machine of the present invention.

FIG. 10 illustrates another example of a movable stabilizer 500*b* for maintaining the portable wrapping machine 10 in a set location. The movable stabilizer 500*b* includes a pair of legs 600 that are deployed outside a periphery of the movable base 12 of the portable wrapping machine 10. The movable stabilizer 500*b* comprises the legs 600 and a leg actuator 602. The legs 600 are pivoted to the movable base 12 at pivot flanges 604 located outside of the posts 70. The legs 600 pivot about the pivot flanges 604 and each include a pad 606 that contacts the floor 30 when the movable stabilizer 500*b* is actuated (as shown in FIG. 10). The leg actuator 602 includes a rotatable handle 610, a linearly movable link 612, a connection block 614 and a pair of actuating rods 616. As the rotatable handle 610 is rotated in a support 618 connected to the top surface 46 of the movable base 12, the linearly movable link 612 is raised and lowered. The rotatable handle 610 is connected to the linearly movable link 612 in any manner that can transfer rotation movement to linear movement (e.g., a rack and pinion system). As the linearly movable link 612 moves up and down, the connection block 614 connected to the linearly movable link 612 also moves up and down on a vertical support pin 620 extending through a vertical hole in the connection block 614. The connection block 614 is also rotatably connected to a first end 624 of the actuating rods 616. As the first end 624 of the actuating rods 616 move upward with the connection block 614, a second end 626 of the actuating rods 616 connected to the legs 600 force the legs 600 to pivot about the pivot flanges 604 to a stored position. Likewise, when the rotatable handle 610 is rotated in an opposite direction, the link 612 and thereby the connection block 614 move downward, thereby moving the actuating rods 616 downward to force the legs 600 about the pivot flanges 604 to move the legs 600 downward to a deployed position which lifts the rear wheels 38 off of the floor 30 (or at least prevents them from rolling).

In the illustrated example, the goods 28 and, if desired, a top portion of the side surface 302 of the pallet 32 can be easily wrapped with wrap film 11 using the portable wrapping machine 10. The base 12 can be positioned to abut the pallet 32 for easily locating the portable wrapping machine 10 in a proper position relative to the pallet 32. It is noted that the base 12 abutting the pallet 32 can include the support plate 34 or any element extending from the support plate 34 and fixed in position relative thereto. As the goods 28 are wrapped, the tension from the wrap film 11 being pulled from the roll 26 and about the goods 28 and/or pallet 32 can pull the base 12 toward the pallet 32 to stabilize the portable wrapping machine 10. It is contemplated that the base 12 could be spaced from the pallet 32 during use and wrapping of the goods 28 as long as the base 12 is held in a stationary position. In such a situation, the front wheel 36 would continue to be located within the wrap circle area 308 and no part of the wrapping machine 10 would be located under the pallet 32.

Figure 11:
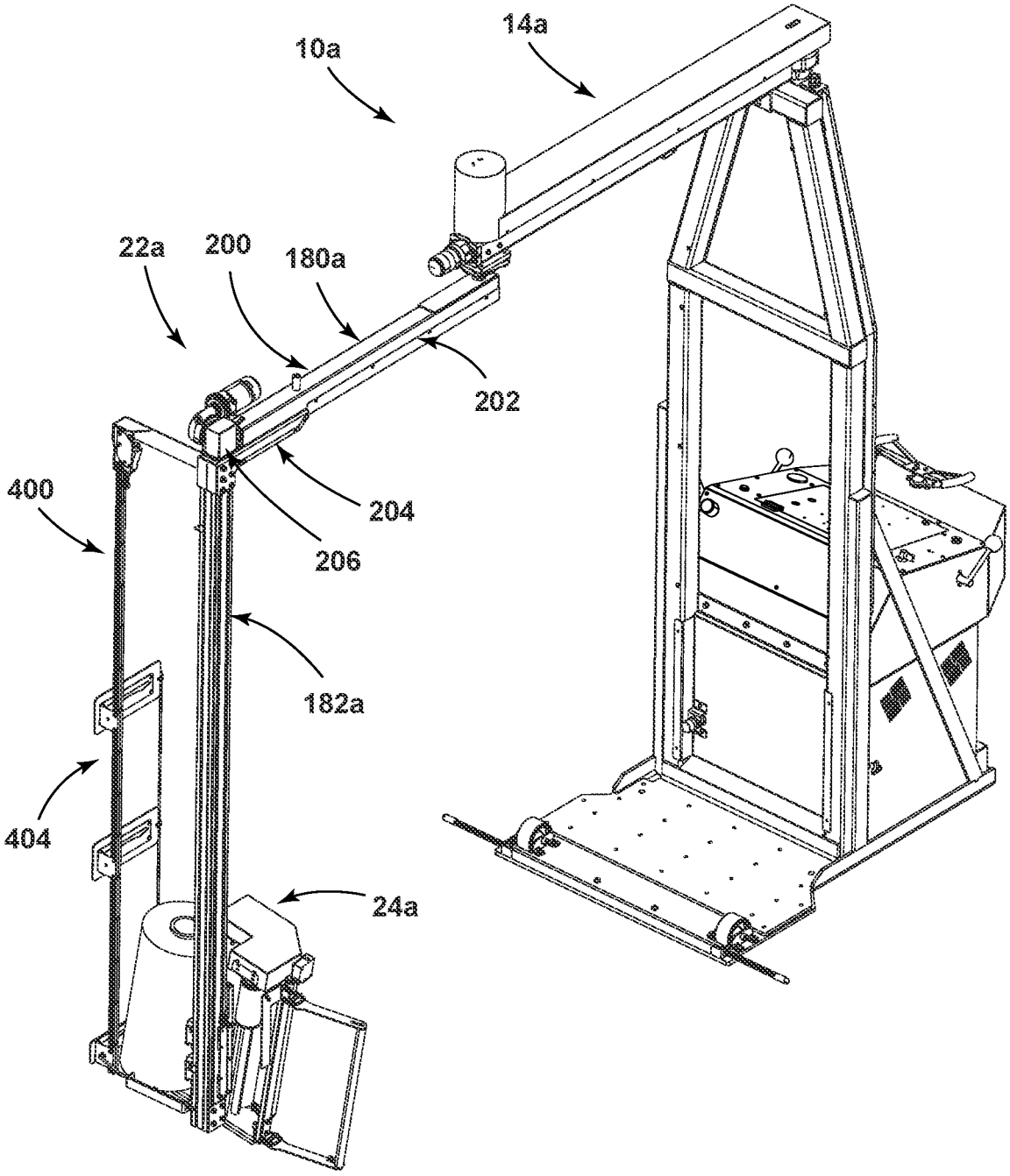
FIG. 11 is a front perspective view of a second embodiment of the portable wrapping machine of the present invention.
Figure 12:
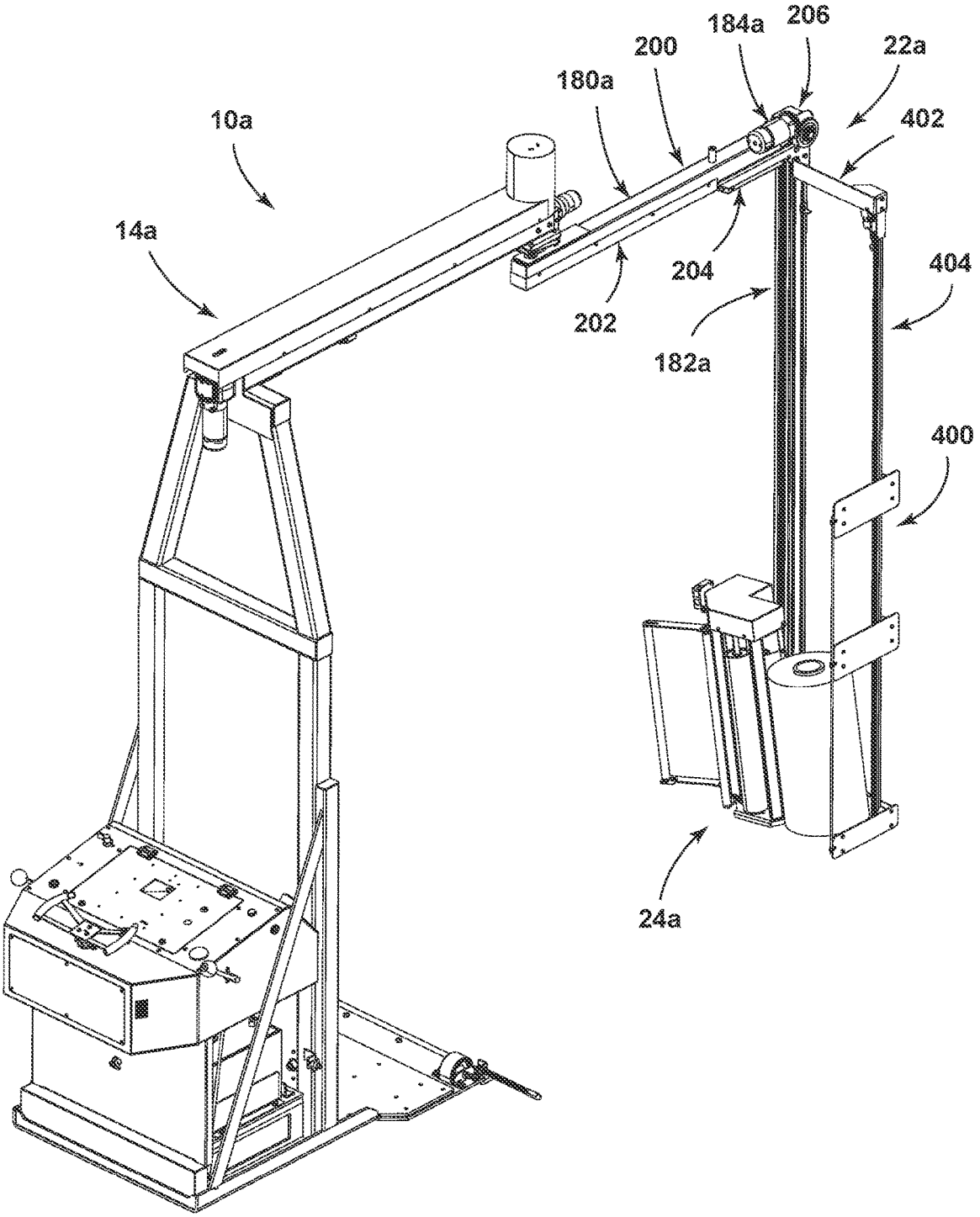
FIG. 12 is a front perspective view of the second embodiment of the portable wrapping machine of the present invention.

The reference numeral 10*a* (FIGS. 11-12) generally designates another embodiment of the present invention, having a second embodiment for the portable wrapping machine. Since the portable wrapping machine 10*a* is similar to the previously described 10, similar parts appearing in FIGS. 1-10 and FIGS. 11-21, respectively, are represented by the same, corresponding reference number, except for the suffix "a" in the numerals of the latter. The second embodiment for the portable wrapping machine 10*a* includes a new inverted L-shaped wrapping arm 22*a* that can be used with either a portable wrapping machine 10*a* as disclosed herein or a stationary wrapping machine that employs an inverted L-shaped wrapping arm. The inverted L-shaped wrapping arm 22*a* includes four features as discussed below: (1) a horizontal portion 180*a*, (2) a vertical portion 182*a*, (3) a connection system between the carriage 24*a* and the vertical portion 182*a*, and (4) a bumper system 400.

In the illustrated example, the horizontal portion 180*a* of the inverted L-shaped wrapping arm 22*a* connects to the relatively stationary portion of the wrapping machine to allow the inverted L-shaped wrapping arm 22*a* to wrap the goods. The horizontal portion 180*a* of the inverted L-shaped wrapping arm 22*a* includes a support beam 200, a U-shaped cover 202, an end connection bracket 204, and a motor and upper sprocket support assembly 206. The support beam 200 can include any cross-section shape (e.g., rectangular) and provides a cantilever support for the rest of the inverted L-shaped wrapping arm 22*a* from the wrapping column 14*a*. The U-shaped cover 202 covers a bottom of the support beam 200 on a proximal end thereof (i.e., the end nearest the wrapping column 14*a*). The U-shaped cover 202 houses any wiring that extends from the wrapping column 14*a* to the rest of the inverted L-shaped wrapping arm 22*a* along the horizontal portion 180*a*.

The illustrated end connection bracket 204 of the horizontal portion 180*a* is connected to the distal end of the support beam 200. The end connection bracket 204 includes an inverted U-shaped bracket 208 having a top plate 210 and a pair of downwardly depending side plates 212. The top plate 210 is fixed to a bottom of the support beam 200. Each of the side plates 212 is L-shaped and has a proximal vertically shorter side 214 and a distal vertically longer connection side 216. A cover plate 218 covers the proximal vertically shorter side 214 and covers wiring entering the end connection bracket 204 from within the U-shaped cover 202. Each of the distal vertically longer connection sides 216 of the side plates 212 have aligned openings therethrough for receiving fasteners 220 for connecting the vertical portion 182*a* to the horizontal portion 180*a*. An end plate 222 covers the end of the inverted U-shaped bracket 208 and is connected to the top plate 210 and the distal vertically longer connection sides 216 of each of the side plates 212 of the inverted U-shaped bracket 208.

Figure 13:
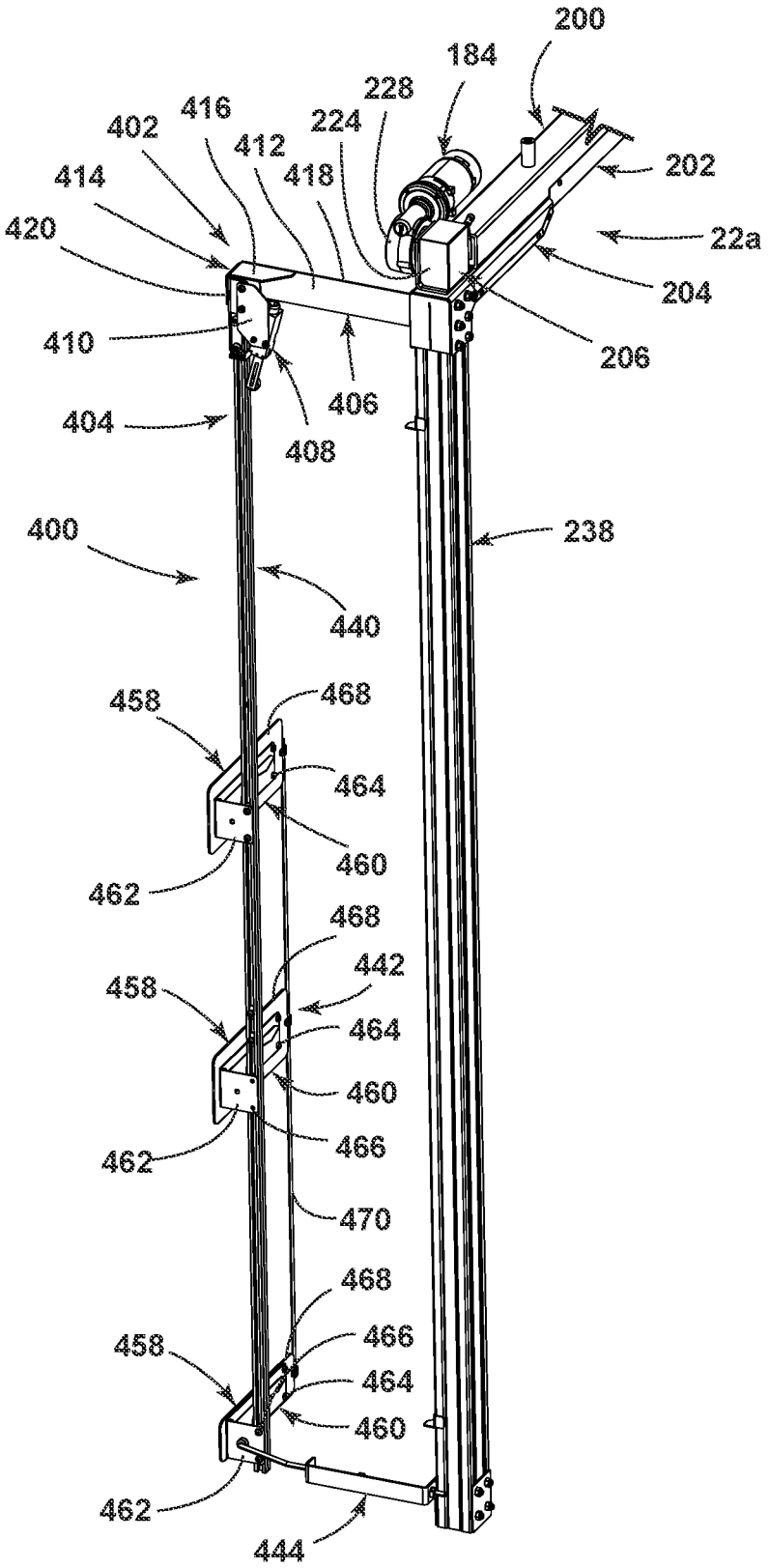
FIG. 13 is a front perspective view of an end of an inverted L-shaped wrapping arm of the second embodiment of the portable wrapping machine of the present invention with a carriage removed.

In the illustrated example, the motor and upper sprocket support assembly 206 supports a second motor assembly 184*a* for moving the carriage 24*a*. The motor and upper sprocket support assembly 206 includes a sprocket housing 224 connected to a top surface of the end connection bracket 204 adjacent a distal end of the support beam 200. The sprocket housing 224 can be substantially a parallelepiped as illustrated in FIG. 13, with four of the sides shown in phantom in FIG. 14 for clarity and to allow the inside of the sprocket housing 224 to be shown. The sprocket housing 224 includes a motor connection wall 226 having the second motor assembly 184*a* (either without or with a right-angle gear box 228) connected thereto. A plurality of fasteners 230 connect the second motor assembly 184 to the motor connection wall 226 and an output shaft 232 extends from the second motor assembly 184 through the motor connection wall 226. It is contemplated that an end of the output shaft 232 could be unsupported or supported on a bearing connected to an interior wall of the sprocket housing 204. The output shaft 232 has a sprocket 234 thereon. A carriage moving cable 236 (e.g., a chain) surrounds a portion of the sprocket 234 to move with rotation of the sprocket 234 to selectively raise and lower the carriage 24*a* to wrap the product as is well known to those skilled in the art. The carriage moving cable 236 extends along and through the vertical portion 182*a*.

Figure 16:
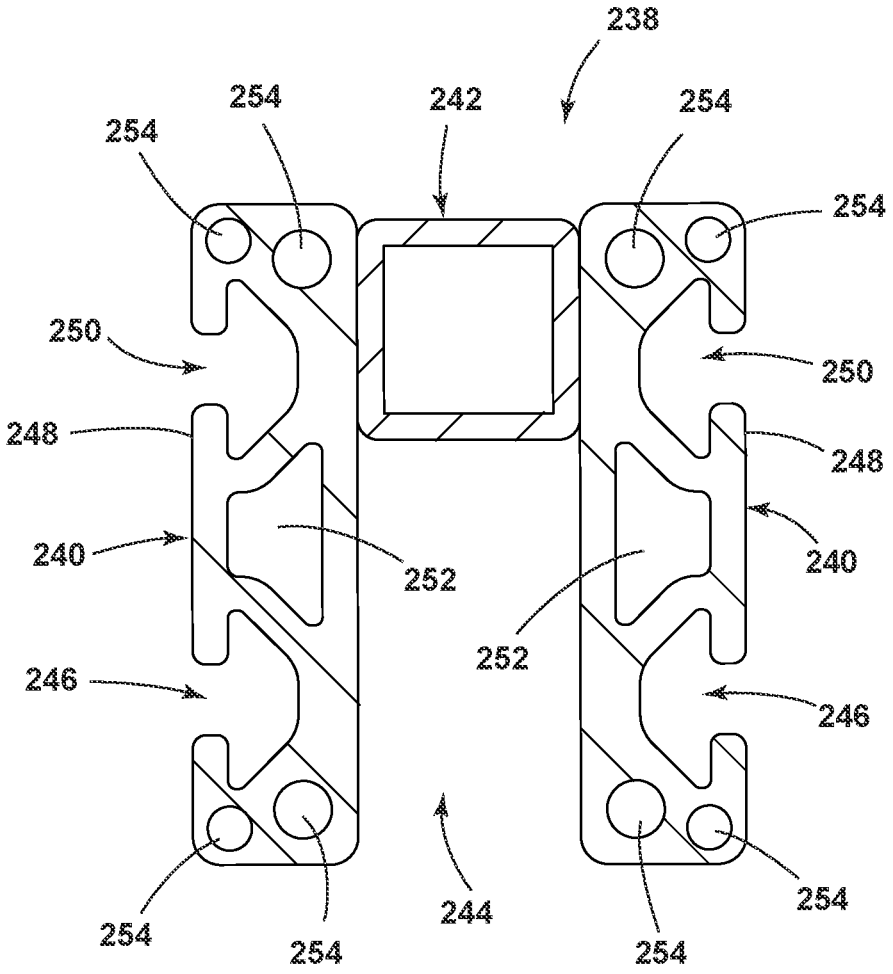
FIG. 16 is a cross-sectional view of a vertical support assembly of a vertical portion of the inverted L-shaped wrapping arm of the second embodiment of the portable wrapping machine of the present invention.

The illustrated vertical portion 182 of the inverted L-shaped wrapping arm 22*a* supports the carriage 24*a* and the carriage 24*a* moves vertically along the vertical portion 182. The vertical portion 182 includes a vertical support assembly 238 (FIG. 16) including a pair of side beams 240 having a substantially rectangular cross section and a spacer beam 242 located between the pair of side beams 240. It is contemplated that the side beams 240 and/or the spacer beam 242 can be formed from an extrusion process (e.g., from aluminum). As shown in FIG. 16, the vertical support assembly 238 forms a substantially U-shaped cross-section, having a central chain opening 244. The carriage moving cable 236 moves through the central chain opening 244. Each of the side beams 240 includes a carriage support slot 246 having a mushroom shape extending into an exterior surface 248 thereof and another similarly shaped mushroom shaped slot 250 aligned with the carriage support slot 246. Each of the side beams 240 can also include a center opening 252 and a plurality of through slots 254 to reduce material and weight of the side beams 240. Each of the side beams 240 have the same shape such that the carriage support slot 246 in a first orientation (e.g., on one side of the spacer beam 242) becomes the mushroom shaped slot 250 in a second orientation (e.g., on the other side of the spacer beam 242) and the mushroom shaped slot 250 in the first orientation becomes the carriage support slot 246 in the second orientation.

Figure 17:
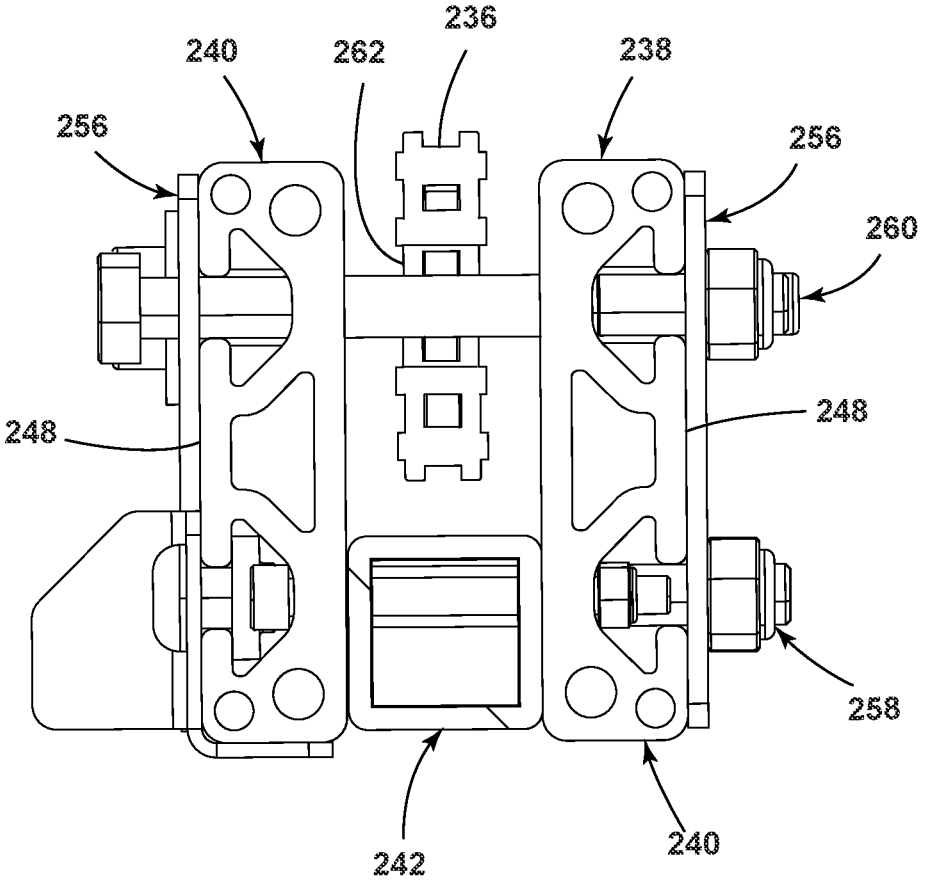
FIG. 17 is a cross-sectional view of the vertical portion of the inverted L-shaped wrapping arm of the second embodiment of the portable wrapping machine of the present invention.

FIG. 17 illustrated a bottom area of the vertical support assembly 238. A side plate 256 covers the exterior surface 248 of each of the side beams 240. First fasteners 258 extend through the side beams 240 and the spacer beam 242 and second fasteners 260 extend through the side beams 240 and the central chain opening 244. As shown in FIG. 17, a bottom sprocket 262 surrounds a bottom one of the second fasteners 260, with the carriage moving cable 236 surrounding the bottom sprocket 262. An alignment wheel (not shown) can surround an upper second fastener to help guide the carriage moving cable 236 about the bottom sprocket 262.

In the illustrated example, the vertical support assembly 238 of the vertical portion 182*a* forms a first portion of a connection system for supporting the carriage 24*a*, with the carriage 24*a* (see FIG. 18) including a support 264 as a second portion of the connection system. The support 264 connects directly to the carriage 24*a* and include a U-shaped bracket 266 having a main panel 268 fastened to the carriage 24*a* by fasteners 270 and a pair of parallel side panels 272 extending from opposite edges of the main panel 268. A plurality of first guide flanges 274 extend from an interior face 276 of the main panel 268 in a central location and parallel to the side panels 272. Each of the side panels 272 include a pair of slide plates 278 connected to interior faces 280 thereof, with each of the slide plates 278 on a single side panel 272 having co-linear second guide flanges 282 extending substantially in a direction perpendicular to the direction of extent of the first guide flanges 274.

Figure 18:
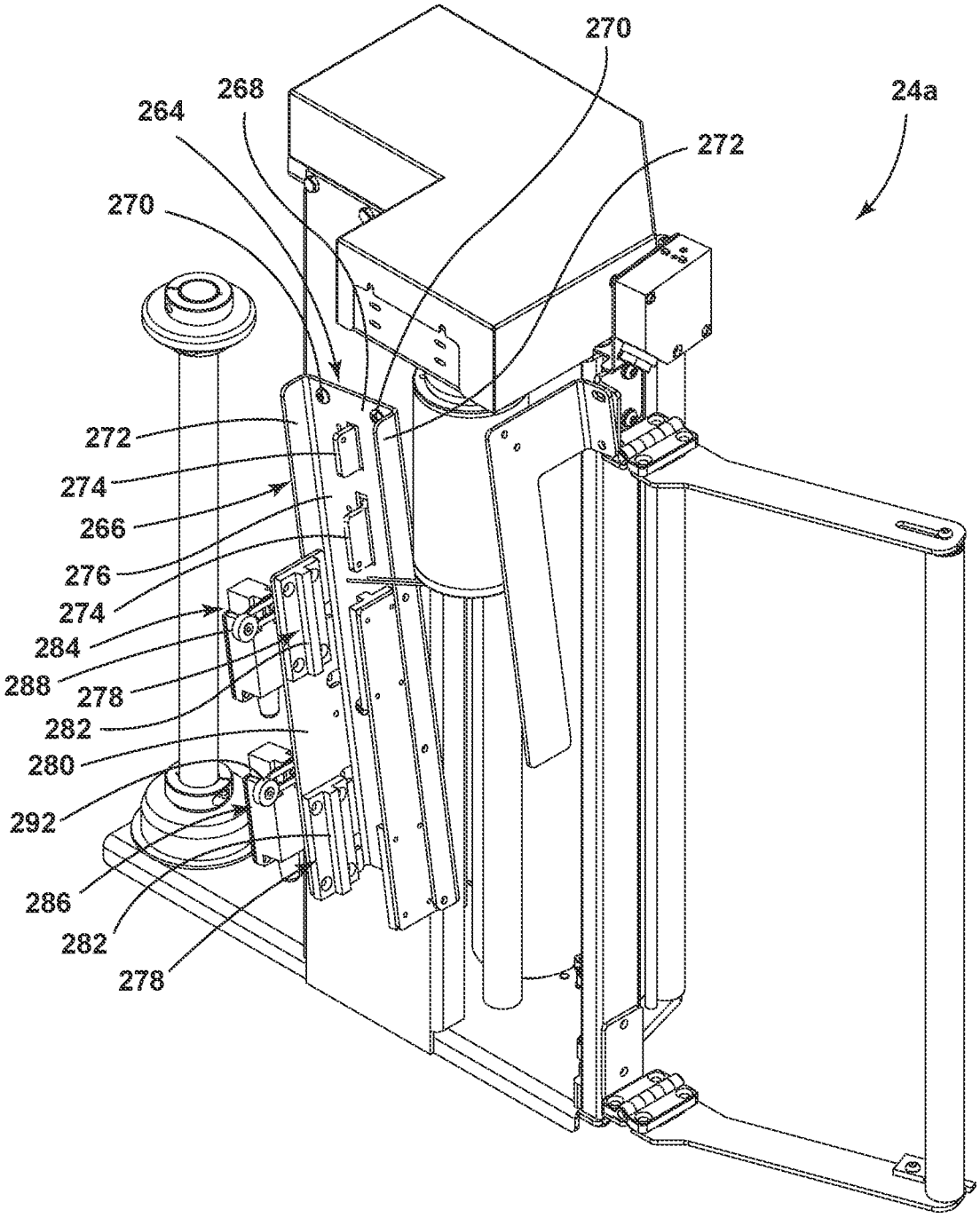
FIG. 18 is a perspective view of a carriage of the second embodiment of the portable wrapping machine of the present invention.

During use, the first guide flanges 274 extend into the central chain opening 244 of the vertical support assembly 238 and the second guide flanges 282 extend into the carriage support openings 244 of the side beams 240 of the vertical support assembly 238. The first guide flanges 274 and the second guide flanges 282 not only connect the carriage 24*a* to the vertical support assembly 238 but also provide for a linear direction of travel for the carriage 24*a* while the carriage 24*a* is raised and lowered by the carriage moving cable 236 under power of the second motor assembly 184. As shown in FIG. 18, the support 264 of the connection system includes an upper limit switch assembly 284 and a lower limit switch assembly 286 connected to one of the side panels 272 of the U-shaped bracket 266. The upper limit switch assembly 284 includes an upper wheel 288 that is configured to abut against an upper stop flange 290 (see FIG. 20) connected to an upper area of the vertical support assembly 238, wherein movement of the upper wheel 288 from contacting the upper stop flange 290 prevents the carriage 24*a* from moving any higher on the vertical support assembly 238. Likewise, the lower limit switch assembly 286 includes a lower wheel 292 that is configured to abut against a lower stop flange 294 (see FIG. 29) connected to a lower area of the vertical support assembly 238, wherein movement of the lower wheel 292 from contacting the lower stop flange 294 prevents the carriage 24*a* from moving any lower on the vertical support assembly 238.

The illustrated bumper system 400 (FIGS. 11-15 and 19-21), when actuated, stops rotation of the inverted L-shaped wrapping arm 22*a* and movement of the carriage 24*a* thereon. The bumper system 400 includes a stationary portion 402 and a movable bumper portion 404. Rotation of the inverted L-shaped wrapping arm 22*a* and movement of the carriage 24*a* thereon stops when the movable bumper portion 404 moves relative to the stationary portion 402.

Figure 14:
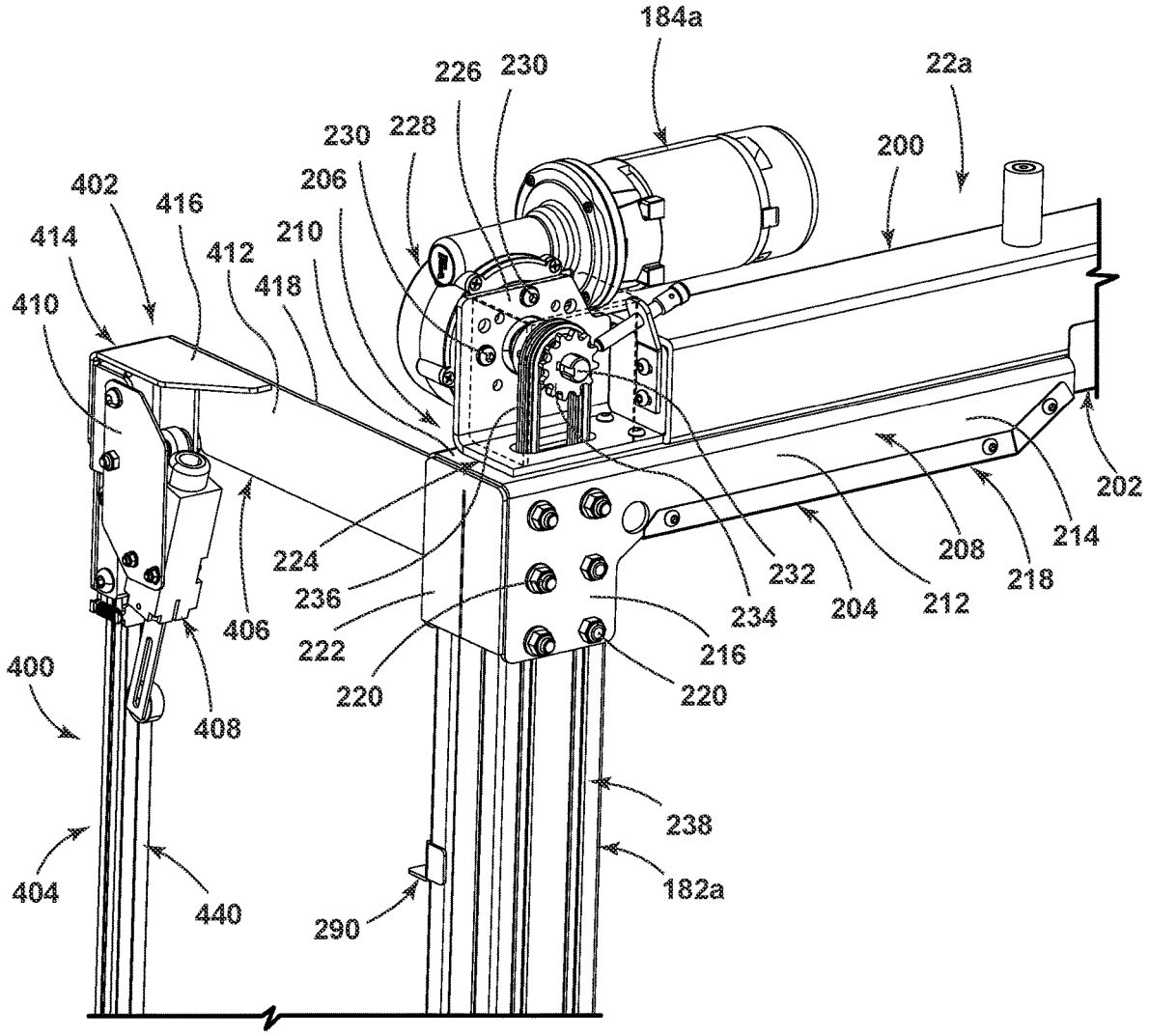
FIG. 14 is a close-up first partial front perspective view of the end of the inverted L-shaped wrapping arm of the second embodiment of the portable wrapping machine of the present invention.

In the illustrated example, the stationary portion 402 of the bumper system 400 connects the bumper system 400 to the inverted L-shaped wrapping arm 22*a*. The stationary portion 402 (FIG. 21) includes a mounting bracket 406, a switch assembly 408 and a mounting plate 410 connecting the switch assembly 408 to the mounting bracket 406, and a pivot connection plate and switch housing 422. The mounting bracket 406 is connected to the support beam 200 of the horizontal portion 180*a* of the inverted L-shaped wrapping arm 22*a*. The mounting bracket 406 can include a panel connected to one of the side plates 212 of the inverted U-shaped bracket 208 of the end connection bracket 204 of the horizontal portion 180*a* as shown in FIG. 14. The mounting bracket 406 also includes a vertical cantilever portion 412 extending laterally from the horizontal portion 180*a* and a distal connection portion 414. The distal connection portion 414 includes a top plate 416 connected to a top edge 418 of the vertical cantilever portion 412 and an end plate 420 connected to an end edge of the vertical cantilever portion 412 and the top plate 416. The pivot connection plate and switch housing 422 is connected to the distal connection portion 414.

Figure 21:
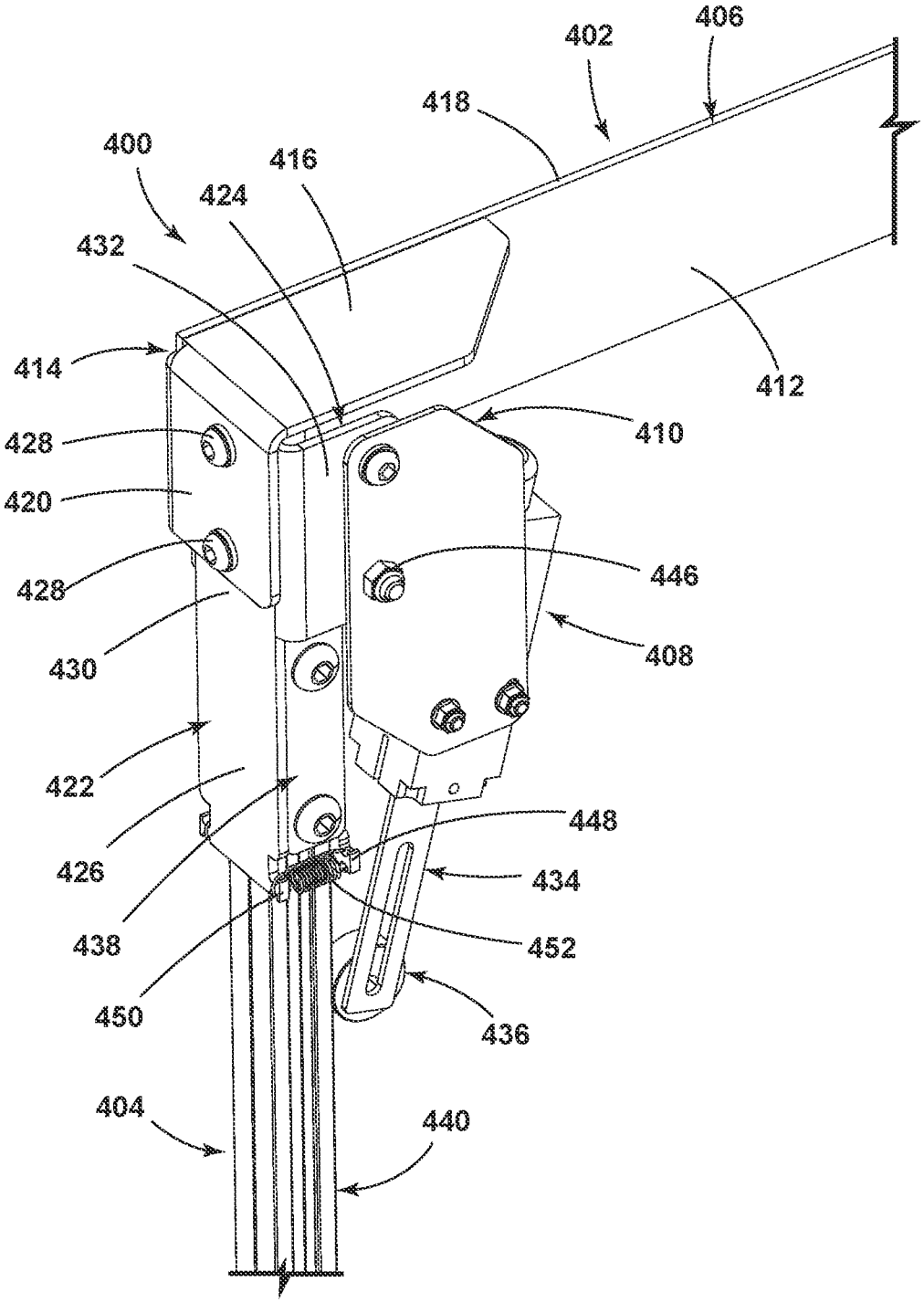
FIG. 21 is a front perspective view of a top of a bumper system of the inverted L-shaped wrapping arm of the second embodiment of the portable wrapping machine of the present invention

The illustrated pivot connection plate and switch housing 422 houses the switch assembly 408 therein and the mounting plate 410 connects the switch assembly 408 to the U-shaped pivot connection plate and switch housing 422. The pivot connection plate and switch housing 422 includes an upper U-shaped area 424 and a lower panel 426. As shown in FIG. 21, fasteners 428 extend through the end plate 420 of the distal connection portion 414 and into a central portion 430 of the upper U-shaped area 424 to connect the pivot connection plate and switch housing 422 to the distal connection portion 414. The mounting plate 410 connects to a side panel 432 of the upper U-shaped area 424 and the switch assembly 408 is connected to the mounting plate 410 in an area adjacent the interior of the upper U-shaped area 424 of the pivot connection plate and switch housing 422. A contact arm 434 having a contact disc 436 on an end thereof extends from the switch assembly 408. The contact disc 436 contacts the movable bumper portion 404 of the bumper system 400 such that movement of the movable bumper portion 404 causes movement of the contact disc 436 and contact arm 434 to thereby actuate the switch assembly 408 to stop rotation of the inverted L-shaped wrapping arm 22*a* and movement of the carriage 24*a* thereon.

In the illustrated example, the movable bumper portion 404 of the bumper system 400 is connected to the stationary portion 402 and configured to move relatively thereto. The movable bumper portion 404 includes a pivot block 438, a main beam 440, a paddle assembly 442 and a bottom support assembly 444. The pivot block 438 is pivotally connected to the upper U-shaped area 424 of the pivot connection plate and switch housing 422. The pivot block 438 is configured to be able to pivot about a pivot pin 446 extending through the mounting plate 410 and the vertical cantilever portion 412 as shown in FIG. 21. The pivot block 438 can pivot away from the pivot connection plate and switch housing 422. The pivot block 438 includes a first finger 448 and a bottom of the lower panel 426 of the pivot connection plate and switch housing 422 has a second finger 450, with a spring 452 connected to the first finger 448 and the second finger 450 to bias the pivot block 438 toward the pivot connection plate and switch housing 422.

The illustrated main beam 440 is connected to the pivot block 438 and supports the paddle assembly 442. The main beam 440 includes a pair of opposite facing C-shaped vertically extending channels 454, with each of the channels 454 having opposing vertically extending lips 456 such that the opening of the channels 454 are smaller than the main portion of the channels 454 (see FIG. 15). Fasteners can extend into the channels 454 and the lips 456 maintain the fasteners within the channels 454.

In the illustrated example, the paddle assembly 442 includes a plurality of paddles 458 connected to the main beam 440. Each of the paddles 458 includes an L-shaped bracket 460 having a first panel 462 connected to the main beam 440 by fasteners 466 extending into the channels 454 of the main beam 440 and a second panel 464 substantially perpendicular to the first panel 462. A bumper shield plate 468 is connected to the second panel 464 of the L-shaped bracket 460. The bumper shield plates 468 act as the bumper for abutting items to actuate the bumper system 400. A support bar 470 can extend along distal free ends of each of the bumper shield plates 468 to provide for a larger bumper area and stability to the paddle assembly 442. It is contemplated that any number of paddles 458 can be used and that the vertical location, size and shape of the paddles 458 can vary. Moreover, it is contemplated that paddle assembly 442 could be used without the support bar 470.

Figure 15:
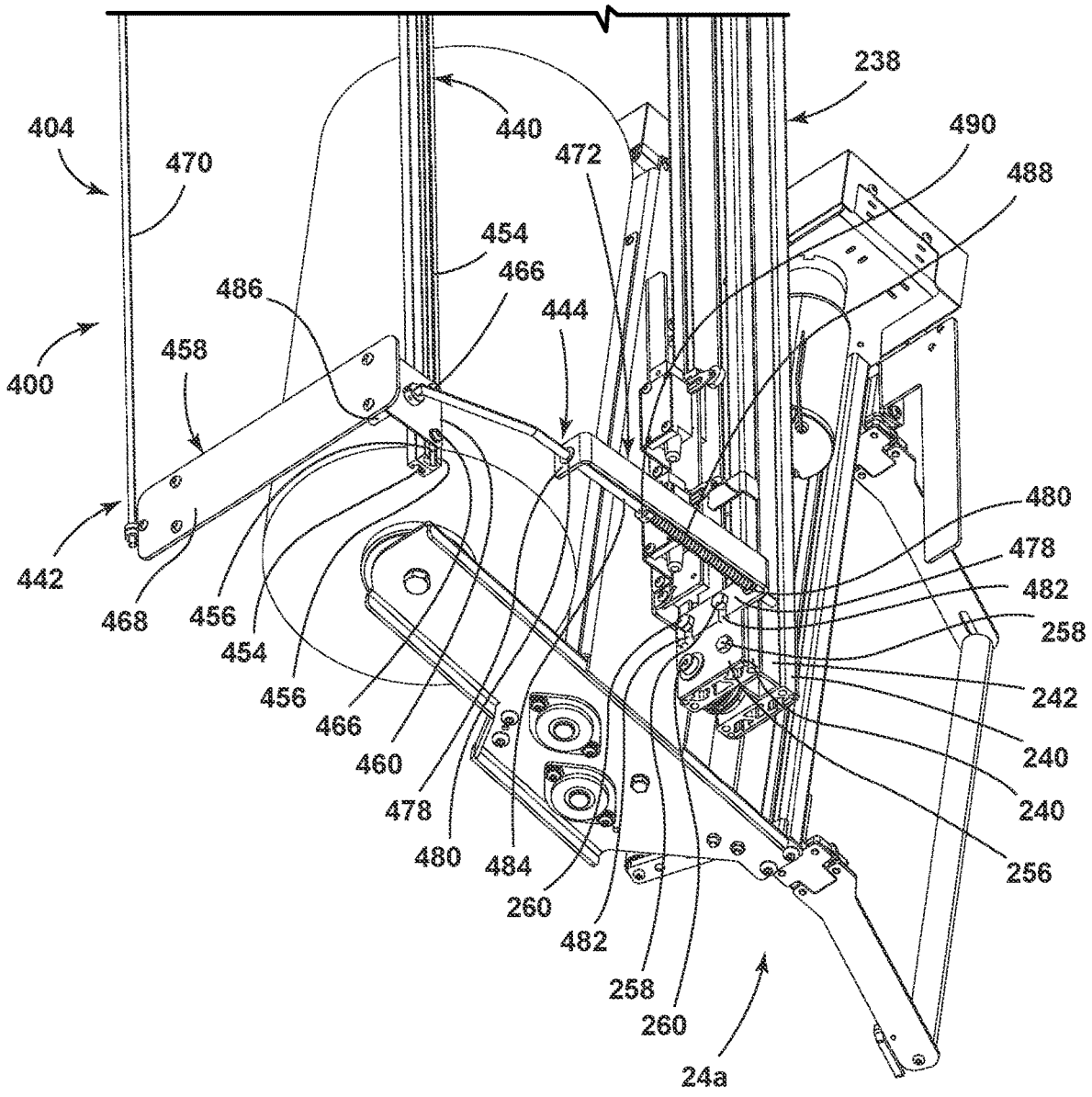
FIG. 15 is a close-up second partial front perspective view of the end of the inverted L-shaped wrapping arm of the second embodiment of the portable wrapping machine of the present invention.
Figure 19:
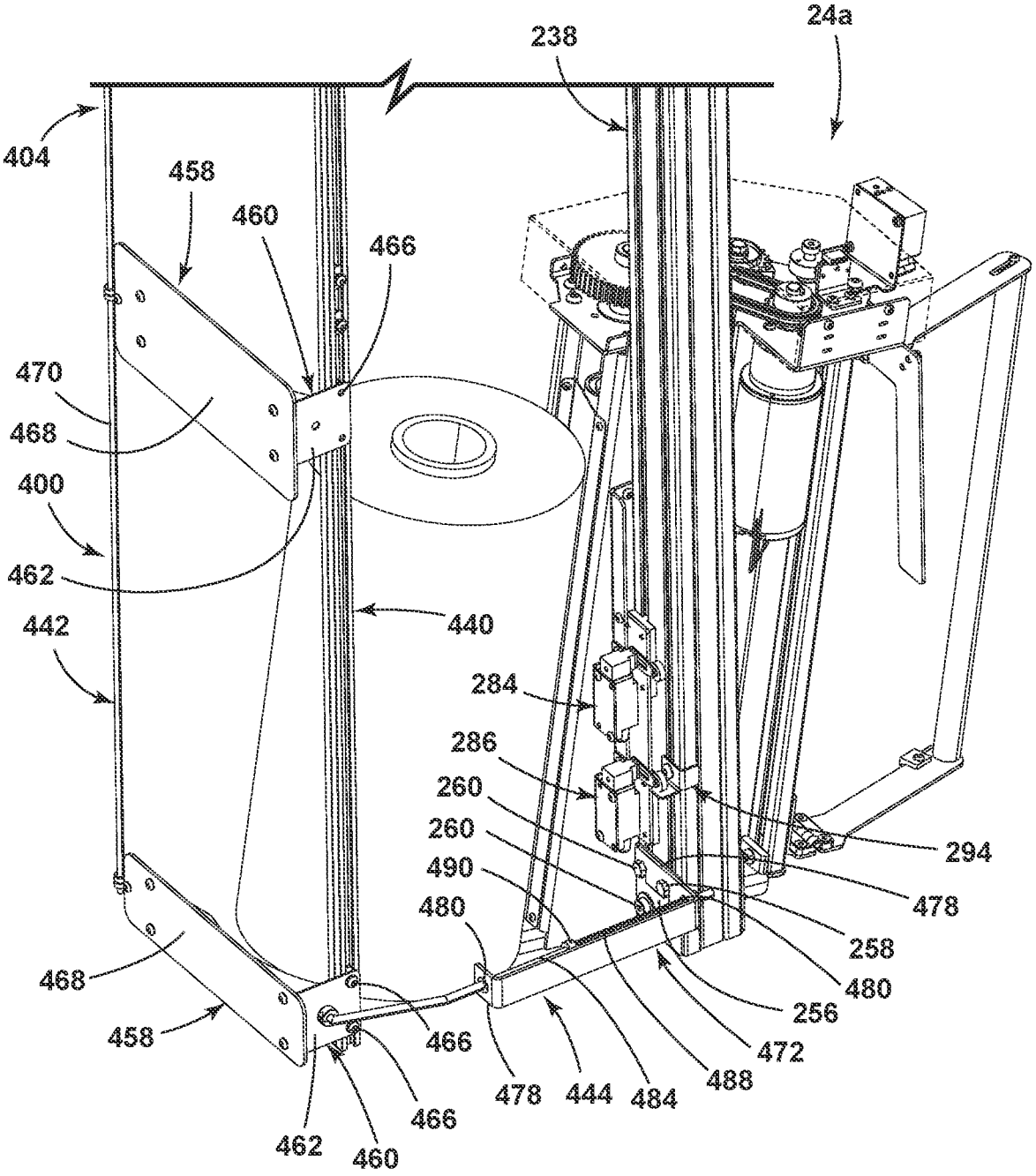
FIG. 19 is a close-up partial side perspective view of the end of the inverted L-shaped wrapping arm of the second embodiment of the portable wrapping machine of the present invention.
Figure 20:
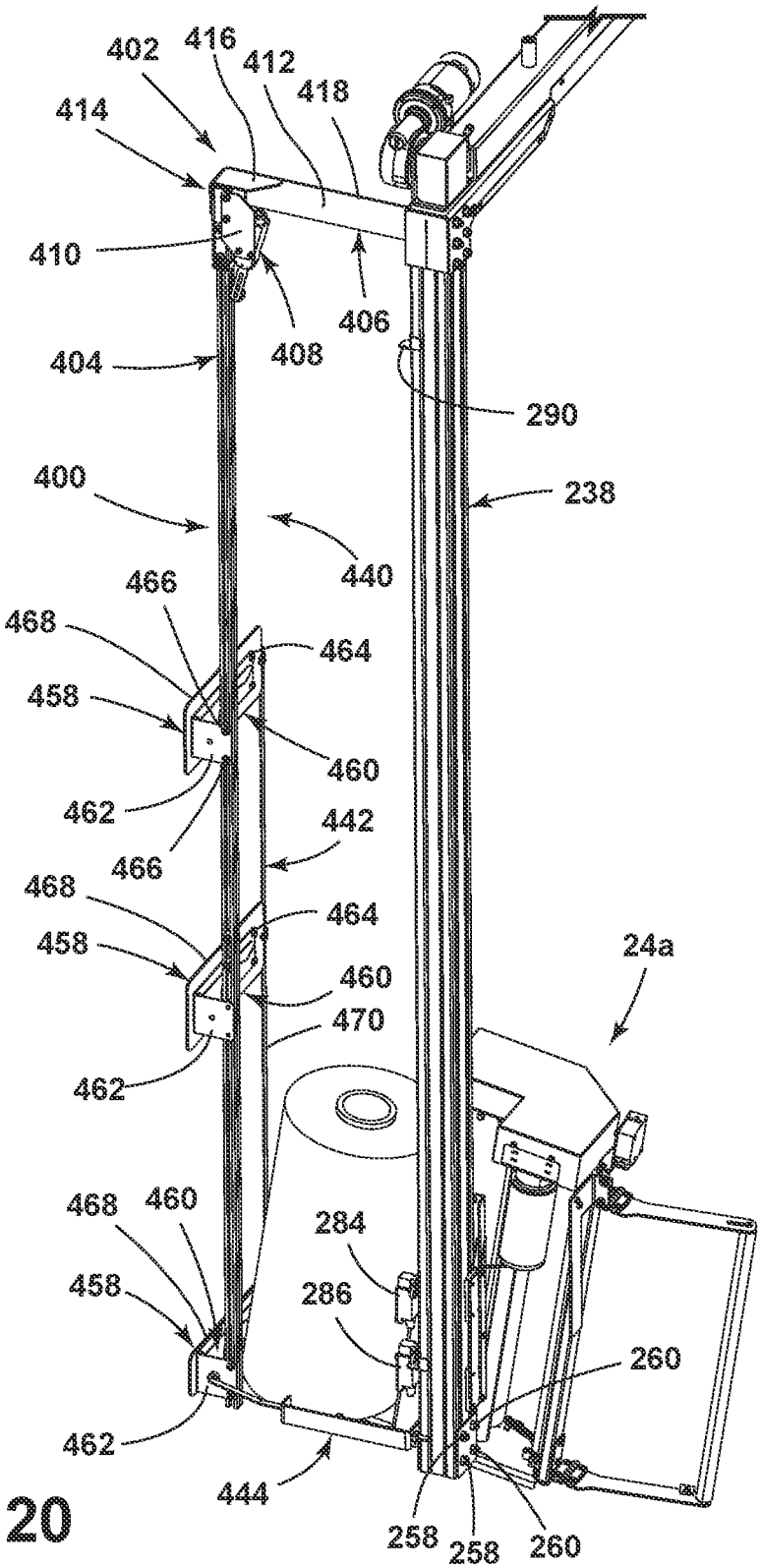
FIG. 20 is a front perspective view of an end of the inverted L-shaped wrapping arm of the second embodiment of the portable wrapping machine of the present invention.

The illustrated bottom support assembly 444 (see FIGS. 15 and 19) supports a bottom of the movable bumper portion 404 of the bumper system 400. The bottom support assembly 444 includes a U-shaped fixed bracket 472, a spring rod 474 and a compression spring 476. The U-shaped fixed bracket 472 includes a pair of opposite end panels 478 each having an aligned opening 480 (that can include a slide bearing). One of the end panels 478 includes a pair of downwardly facing slots 482. Fasteners 260 extend through the slots 482 to fixedly connect the U-shaped fixed bracket 472 to the side plate 256 that covers the exterior surface 248 of each of the side beams 240 as shown in FIGS. 15 and 19. The spring rod 474 includes a straight area 484 that is allowed to freely slide through the aligned openings 480 in the U-shaped fixed bracket 472. The spring rod 474 also includes an angled portion 486 that is fixedly connected to the first panel 462 of the L-shaped bracket 460 of the bottom paddle 458 of the paddle assembly 442. As the movable bumper portion 404 of the bumper system 400 rotates about the pivot pin 446 as outlined above, the spring rod 474 slides through the aligned openings 480. A compression spring 488 is compressed between the one of the end panels 478 with slots 482 and a collar 490 connected to the spring rod 474 when the movable bumper portion 404 of the bumper system 400 rotates about the pivot pin 446, with the compression spring 488 biasing the movable bumper portion 404 of the bumper system 400 back to a home position.

The illustrated portable wrapping machine 10*a* provides for an easy to manufacture system that allows for stoppage of the system when the inverted L-shaped wrapping arm 22*a* abuts up against an item or person in the way of wrapping a product.

The above description is considered that of the one embodiment only. Modification of the invention will occur to those skilled in the art and to those who make or use the invention. Therefore, it is understood that the embodiment shown in the drawings and described above is merely for illustrative purposes and not intended to limit the scope of the invention.

What is claimed is:

1. A wrapping machine comprising:

a base; and a wrapping column connected to the base, the wrapping column including a carriage vertically movable on the wrapping column, the carriage having a roll of wrap film;

a motor for moving the carriage vertically on the wrapping column to wrap a product;

a link connecting the motor and the carriage for moving the carriage on the wrapping column;

the wrapping column including a pair of side beams connected by a connection beam located between the side beams, the pair of side beams forming a link recess between the side beams and adjacent the connection beam, the link recess being open opposite the connection beam;

each of the side beams including an exteriorly facing slot, the carriage riding on the side beams along the slot of each of the side beams; and the link moving within the link recess to move the carriage along the wrapping column.

2. The wrapping machine according to claim 1, wherein:

the wrapping column is configured to move in a substantially circular direction;

the wrapping column being connected to the base such that the wrapping column can move in the substantially circular direction about the product to wrap the product with film; and further including a bumper assembly movable with the wrapping column, the bumper assembly including a bumper and an actuator, wherein engagement of the bumper with an external object will actuate the actuator to stop movement of the wrapping column about the product.

3. The wrapping machine according to claim 2, wherein:

engagement of the bumper with the external object will also stop movement of the carriage on the wrapping column.

4. The wrapping machine according to claim 2, wherein:

the bumper is biased away from the wrapping column such that the bumper is moved against the bias to actuate the actuator.

5. The wrapping machine according to claim 2, wherein:

the base is movable to be able to move into position adjacent the product.

6. The wrapping machine according to claim 2, wherein:

the carriage includes pre-stretch rollers for pre-stretching the wrap film within the carriage.

7. The wrapping machine according to claim 2, wherein:

the base includes a vertical support and a horizontal support cantilevered from an upper end of the vertical support.

8. The wrapping machine according to claim 2, wherein:

the bumper comprises a plurality of paddles rigidly connected together; and abutment of at least one of the paddles moves the bumper against a bias to actuate the actuator.

9. A method of safely wrapping goods comprising:

providing the wrapping machine according to claim 2;

moving the wrapping column about the product in the substantially circular direction and moving the carriage vertically to wrap the product with film from the roll of wrap film;

moving the bumper assembly with the wrapping column, the bumper assembly being pivotally connected adjacent a top of the wrapping column at a pivot connection and including a bumper; and stopping movement of the wrapping column when the bumper abuts an external object, causing the bumper assembly to pivot about the pivot connection.

10. The method according to claim 9, further including:

providing the bumper assembly with the actuator, wherein stopping movement of the wrapping column occurs from the bumper actuating the actuator.

11. The method according to claim 9, further including:

stopping movement of the carriage on the wrapping column upon engagement of the bumper with the external object.

12. The method according to claim 9, further including:

biasing the bumper such that the bumper is moved against the bias to stop movement of the wrapping column.

13. The method according to claim 9, further including:

moving the wrapping machine into position adjacent the product.

14. The method according to claim 9, wherein:

the carriage includes pre-stretch rollers for pre-stretching the wrap film within the carriage.

15. The method according to claim 9, wherein:

the base includes a vertical support and a horizontal support cantilevered from an upper end of the vertical support.

16. The method according to claim 9, wherein:

the bumper comprises a plurality of paddles rigidly connected together;

abutment of at least one of the paddles moves the bumper to stop movement of the wrapping column.

17. The wrapping machine according to claim 1, wherein:

the wrapping column comprises a vertical portion of a wrapping arm, the wrapping arm being L-shaped and further including a horizontal portion connected to the base.

18. The wrapping machine according to claim 1, wherein:

the wrapping column further includes a pair of pulley wheels located within the link recess, the link extending around each of the pulley wheels.

19. The wrapping machine according to claim 1, wherein:

the side beams have an identical configuration.

20. The wrapping machine according to claim 19, wherein:

the side beams are formed of extruded metal.

21. The wrapping machine according to claim 1, wherein:

the carriage includes a plurality of flanges extending into the exteriorly facing slots and the link recess.

* * * * *